US009754573B2

(12) United States Patent
Truchsess et al.

(10) Patent No.: US 9,754,573 B2
(45) Date of Patent: Sep. 5, 2017

(54) ELECTRONIC CYMBAL TRIGGER

(71) Applicant: Avedis Zildjian Co., Norwell, MA (US)

(72) Inventors: Julia D. Truchsess, Sandy Hook, CT (US); John V. Roderick, Marshfield, MA (US)

(73) Assignee: Avedis Zildjian Co., Norwell, MA (US)

( * ) Notice: Subject to any disclaimer, the term of this patent is extended or adjusted under 35 U.S.C. 154(b) by 0 days.

(21) Appl. No.: 14/963,161

(22) Filed: Dec. 8, 2015

(65) Prior Publication Data

US 2016/0163300 A1 Jun. 9, 2016

Related U.S. Application Data

(63) Continuation of application No. 14/206,423, filed on Mar. 12, 2014, now Pat. No. 9,245,510.

(51) Int. Cl.

| | |
|---|---|
| ***G10H 1/18*** | (2006.01) |
| ***G10H 1/32*** | (2006.01) |
| ***G10H 3/14*** | (2006.01) |
| ***G10H 3/10*** | (2006.01) |
| ***H04R 31/00*** | (2006.01) |
| ***G10H 1/12*** | (2006.01) |
| ***G10D 13/02*** | (2006.01) |

(52) U.S. Cl.

CPC ..... *G10H 3/146* (2013.01); *G10D 13/024* (2013.01); *G10H 1/12* (2013.01); *G10H 1/18* (2013.01); *G10H 1/32* (2013.01); *G10H 3/10* (2013.01); *G10H 3/143* (2013.01); *H04R 31/006* (2013.01); *G10H 2210/051* (2013.01); *G10H 2230/321* (2013.01); *G10H 2230/325* (2013.01); *G10H 2250/025* (2013.01); *Y10T 29/49005* (2015.01)

(58) Field of Classification Search

CPC ..... G10H 1/18; G10H 1/32; G10H 2230/321; G10H 2230/325; G10H 3/146

USPC ..... 84/723, 737

See application file for complete search history.

(56) References Cited

U.S. PATENT DOCUMENTS

| | | | |
|---|---|---|---|
| 3,553,339 | A | 1/1971 | Dominguez et al. |
| 3,748,367 | A | 7/1973 | Lamme et al. |

(Continued)

OTHER PUBLICATIONS

International Search Report and Written Opinion for International Application No. PCT/US15/20256 dated Jun. 24, 2015.

(Continued)

*Primary Examiner* — David Warren

(74) *Attorney, Agent, or Firm* — Wolf, Greenfield & Sacks, P.C.

(57) ABSTRACT

According to some aspects, a cymbal system is provided comprising a metal plate, a transducer coupled to the metal plate and configured to detect an acoustic signal generated by a strike of the metal plate, and processing circuitry, electrically connected to the transducer, configured to determine a cymbal articulation for the strike of the metal plate based on the detected acoustic signal. According to some aspects, a method is provided comprising the steps of detecting an acoustic signal generated by a strike of a metal plate, and determining a cymbal articulation for the strike of the metal plate based on the detected acoustic signal.

11 Claims, 28 Drawing Sheets

(56) References Cited

U.S. PATENT DOCUMENTS 4,248,129 A * 2/1981 Zildjian ..... G10D 13/065 84/402
5,262,585 A * 11/1993 Greene ..... G10H 1/0066 84/645
8,865,986 B1 * 10/2014 Twyford ..... G10D 13/06 84/402
9,245,510 B2 1/2016 Truchsess et al.
2002/0059861 A1 * 5/2002 Yoshino ..... G10D 13/024 84/402
2003/0188629 A1 * 10/2003 Suenaga ..... G10H 3/146 84/723
2005/0039593 A1 * 2/2005 Wachter ..... G10H 3/146 84/730
2005/0150366 A1 * 7/2005 Susami ..... G10H 3/146 84/735
2005/0257672 A1 * 11/2005 Arimoto ..... G10H 1/02 84/738
2007/0131090 A1 * 6/2007 Stannard ..... G10D 13/06 84/422.4
2008/0034946 A1 * 2/2008 Aimi ..... G10H 3/146 84/604
2010/0064881 A1 * 3/2010 Takehisa ..... G10H 3/146 84/609
2010/0180750 A1 * 7/2010 Steele ..... G10H 1/32 84/422.3
2011/0056361 A1 * 3/2011 Steele ..... G10H 1/348 84/422.3
2012/0048099 A1 * 3/2012 Wissmuller ..... G10H 1/348 84/723
2012/0060670 A1 * 3/2012 Truchsess ..... G10D 13/06 84/724
2012/0118130 A1 * 5/2012 Field ..... G10H 3/146 84/730
2012/0144980 A1 * 6/2012 Roderick ..... G10H 3/143 84/723
2013/0047826 A1 * 2/2013 Wissmuller ..... G10H 3/00 84/723
2014/0053713 A1 2/2014 Truchsess
2014/0298978 A1 * 10/2014 Yoshino ..... G10H 1/32 84/743
2015/0262567 A1 9/2015 Truchsess et al.

OTHER PUBLICATIONS

International Preliminary Report on Patentability for International Application No. PCT/US15/20256 dated Sep. 9, 2016.

* cited by examiner

ELECTRONIC CYMBAL TRIGGER

RELATED APPLICATIONS

This application is a continuation claiming the benefit under 35 U.S.C. §120 of U.S. patent application Ser. No. 14/206,423 filed Mar. 12, 2014 and entitled "Electronic Cymbal Trigger," which is incorporated herein by reference in its entirety.

BACKGROUND

Conventional electronic drum sets typically consist of drum and/or cymbal shaped devices, which may incorporate one or more switches to identify when the device has been struck. In particular, conventional electronic cymbals are typically made of rubber and include mechanical switches at different locations on or nearby the cymbal. The switches may be located at various positions so that when the cymbal is struck, the movement of the cymbal causes one or more of the switches to be engaged.

Electronic cymbals are typically used in conjunction with an electronic tone generator, commonly referred to as a "drum module" or "drum brain," to which the electronic cymbals are connected. These drum modules are passed trigger signals generated by the electronic cymbals, which enable the drum modules to play sounds corresponding to an action that caused the trigger event. A switch engaged by a strike of the cymbal may, in conjunction with an impact sensor, generate a trigger signal corresponding to that switch, and may thereby cause a corresponding sound to be played by a connected drum module.

SUMMARY

Some embodiments provide a cymbal system comprising a metal plate, a transducer coupled to the metal plate and configured to detect an acoustic signal generated by a strike of the metal plate, and processing circuitry, electrically connected to the transducer, configured to determine a cymbal articulation for the strike of the metal plate based on the detected acoustic signal.

Some embodiments include a method comprising detecting an acoustic signal generated by a strike of a metal plate, and determining a cymbal articulation for the strike of the metal plate based on the detected acoustic signal.

The foregoing is a non-limiting summary of the invention, which is defined only by the appended claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
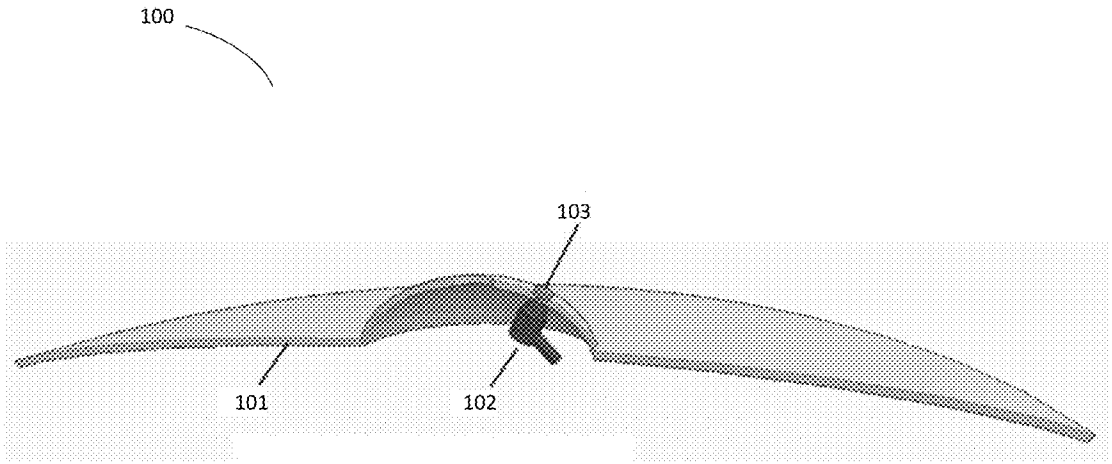
FIG. 1 illustrates a cross-section of an exemplary cymbal suitable for practicing some embodiments.

The inventors have recognized and appreciated that an electronic cymbal with the feel of a traditional metal cymbal may be provided by performing analysis of the acoustic response generated by a strike of a cymbal to determine a manner in which the cymbal was struck. By performing a suitable analysis of the acoustic response resulting from the strike, such as, but not limited to, analysis of an amplitude and/or a frequency of the acoustic response, information indicating the manner in which the cymbal was struck may be determined.

Conventional electronic cymbals may utilize switches which are mechanically complex, require involved wiring and may become damaged upon repeated use. The inventors have recognized and appreciated that by determining a manner in which a cymbal was struck using acoustic analysis rather than using one or more mechanical switches, construction of an electronic cymbal may be simplified and the resulting electronic cymbal may be more reliable as a result.

Furthermore, conventional electronic cymbals may be constructed from rubber or other similar materials, and may consequently not feel to a player of the cymbal like a traditional metal cymbal, and/or may not be as aesthetically pleasing as a traditional metal cymbal. A metal-based electronic cymbal may, however, provide a player with a playing experience, or "feel," similar to that of a traditional cymbal. The inventors have recognized and appreciated that an electronic cymbal having the feel of a traditional cymbal may be provided by performing analysis of the acoustic response of a metal cymbal, as described herein.

Acoustic cymbals generally produce different types of sound and/or vibration depending on where they are struck. While there are many variations of such strikes, in general cymbal strikes can be divided into broad categories, such as "bell," "bow" or "edge" strikes. A player of a cymbal can also perform a "choke" operation by grabbing the cymbal by the hand to quickly dampen the sound. These categories are collectively referred to as "cymbal articulations".

The inventors have recognized and appreciated that analysis of the acoustic response of a metal cymbal as a result of a strike of the cymbal may be used to determine a cymbal articulation corresponding to the strike. For example, the acoustic response of the cymbal may be used to distinguish a bell strike from a bow strike.

In some embodiments, particular characteristics of the acoustic signal resulting from a cymbal strike may be used to determine a cymbal articulation. For example, characteristics such as, but not limited to, a signal risetime, a signal amplitude, a signal frequency, and/or combinations thereof, may be used to determine a cymbal articulation. In some embodiments, a high amplitude signal may indicate a bell strike; in some embodiments a low-frequency signal may indicate an edge strike; and in some embodiments a sudden drop in signal amplitude may indicate a choke.

A cymbal suitable for use with embodiments described herein may be constructed to reduce the acoustic amplitude of strikes while retaining some acoustic properties of a traditional metal cymbal. Such a cymbal may have an acoustic response that is easier to analyze than a traditional metal cymbal, since the acoustic signal obtained from a strike of such a cymbal may be cleaner (e.g., might have a higher signal to noise ratio). In some embodiments, a cymbal is constructed from a thin metal and/or is coated with a dampening element, and/or comprises a plurality of perforations, each of which may serve to reduce the volume resulting from a strike of the cymbal.

In some embodiments, identification of a cymbal articulation corresponding to a strike of a cymbal as described herein may be used to generate a trigger signal. For example, a trigger signal may be provided to a hardware and/or software device to initiate playback of a stored audio sample, such as by providing a trigger signal to a suitable drum module.

Acoustic signals as described herein may include any type of longitudinal wave or waves propagating through any medium or media, such as, but not limited to, sound waves, acoustic waves, surface acoustic waves (SAWs), Rayleigh waves, and/or combinations thereof. Acoustic signals generated from a strike of a cymbal as described herein may be captured by a transducer. In some embodiments, a transducer may be coupled to a cymbal and used to produce an electrical signal in response to an acoustic signal resulting from a strike of the cymbal. As a result, the combination of cymbal and transducer may form an electronic cymbal having the advantages and qualities described herein.

A cymbal articulation determined based on an acoustic signal generated by the electronic cymbal described herein may be determined using suitable analog and/or digital processing components and/or techniques. For example, one or more analog signal processing components may be used in the determination of the cymbal articulation. In addition, or alternatively, a microcontroller suitably programmed to perform digital signal analysis may be used in the determination of a cymbal articulation.

Techniques described herein may be applicable to use cases in which a player wishes to play an electronic cymbal that produces digitally generated sounds in response to a strike of the cymbal, yet the player also desires a playing experience akin to that of a traditional metal cymbal.

Techniques described herein may additionally be applicable to use cases in which it is desirable to play a cymbal quietly yet for the cymbal player to adequately hear the response of the cymbal. For example, during practice playing in a home environment, a player may wish to experience the feel of a traditional metal acoustic cymbal yet it may be undesirable to produce the volume level typically associated with a traditional metal acoustic cymbal.

Following below are more detailed descriptions of various concepts related to, and embodiments of, an electronic cymbal. It should be appreciated that various aspects described herein may be implemented in any of numerous ways. Examples of specific implementations are provided herein for illustrative purposes only. In addition, the various aspects described in the embodiments below may be used alone or in any combination, and are not limited to the combinations explicitly described herein.

Figure 8:
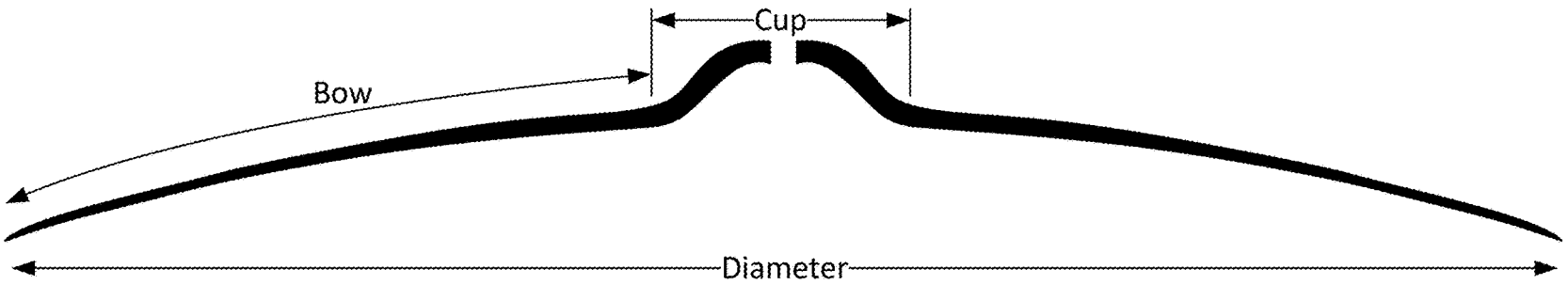
FIG. 8 illustrates an exemplary cymbal cross-section, according to some embodiments.

FIG. 1 illustrates a cross-section of an exemplary electronic cymbal suitable for practicing some embodiments. Electronic cymbal 100 includes cymbal 101 coupled to transducer 102 via coupler 103. Cymbal 101 may be of any suitable shape, though in some embodiments may include a bell or cup region in the center of the cymbal as shown in FIG. 1. FIG. 8 illustrates an exemplary cymbal cross-section in order to denote the general regions associated with traditional metal cymbals, including bow and cup regions, according to some embodiments. It should be appreciated that in general the cymbals discussed herein may be of any suitable size and/or shape, though may in some embodiments have the general form shown in FIG. 8. The specific dimensions of each region may be of any suitable size, however, both in terms of absolute sizes and relative sizes. For example, a cymbal having a small or negligible cup region may be used with embodiments described herein.

Cymbal 101 may comprise any suitable material, or combination of materials. In some embodiments, cymbal 101 is constructed from a material that is suitably rigid so as to produce sounds when struck and/or has a hardness such that repeated strikes of the cymbal will not significantly dent or damage the material. In some embodiments, cymbal 101 comprises a metal. In some embodiments, cymbal 101 comprises bronze. In such embodiments, any formulation of a bronze alloy comprising copper and tin in addition to any number and any type of other substances may be used, including but not limited to 92% copper and 8% tin alloys (commonly known as "B8"), 80% copper and 20% tin alloys (commonly known as "B20"), Paiste Sound Alloy, other bronze alloys, and/or any combinations thereof.

Cymbal 101 may be of any suitable size and/or shape. In the example of FIG. 1, cymbal 101 is circular when viewed from above, and has the cross-section as shown in FIG. 8. However cymbal 101 is not limited to cymbals that have this particular shape or cross-section, and it will be appreciated that the cymbal depicted in FIG. 1 is provided as an example. Moreover, cymbal 101 may be of any suitable size, including diameters between 6 inches and 30 inches, and thicknesses between 1 mm and 10 mm. However, cymbal 101 may also be a vertically mounted gong, for example, and have a diameter between 1 foot and 6 feet.

In some embodiments, cymbal 101 is of a size and shape corresponding to a particular categorization of cymbal types, including but not limited to cymbals commonly known as a ride, a crash, a hi-hat, a crash/ride, a splash, a China cymbal, and/or a marching cymbal. It will be appreciated that cymbal types, including those indicated above, may be formed in a variety of shapes and sizes, and that the types indicated are broad categorizations known to those of skill in the art.

In some embodiments, cymbal 101 incorporates one or more perforations. Such perforations may be of any suitable size and may be provided in any number and at any location(s) on the cymbal. Perforations of the cymbal may have an effect that an amplitude of acoustic waves generated by a strike of the cymbal are reduced in comparison with an identical cymbal having fewer, or completely lacking in, perforations. While perforations of cymbal 101 may reduce an amplitude of acoustic waves generated by a strike of a cymbal, the perforations may be incorporated in such a way as to retain the playing feel of the cymbal.

In some embodiments, cymbal 101 comprises a resilient coating applied over metal. A resilient coating may be formed from any suitable material that can adhere to at least a part of the surface of cymbal 101 and that dampens sound waves propagating through the cymbal. Such a coating may have an effect that an amplitude of acoustic waves generated by a strike of the cymbal are reduced in comparison with an cymbal identical but for the coating. While a resilient coating applied to cymbal 101 may reduce an amplitude of acoustic waves generated by a strike of a cymbal, the coating may be incorporated in such a way as to retain the playing feel of the cymbal.

In some embodiments, cymbal 101 includes a dampening element. A dampening element may be attached to any location of cymbal 101, for example dampening element may be attached to the circumference of the cymbal. The dampening element may comprise any suitable material that has the effect of dampening vibratory sound waves propagating within the cymbal. The dampening element may have an effect that an amplitude of acoustic waves generated by a strike of the cymbal are reduced in comparison with an cymbal identical but for the dampening element. While a dampening element of cymbal 101 may reduce an amplitude of acoustic waves generated by a strike of a cymbal, the dampening element may be incorporated in such a way as to retain the playing feel of the cymbal.

Transducer 102 may be any suitable device able to convert acoustic waves generated by a strike of the cymbal (e.g., in the air and/or in the cymbal) into another form of energy. In some embodiments, transducer 102 is a vibratory transducer configured to convert vibratory energy into electrical energy. However, in general transducer 102 may include any suitable piezoelectric, capacitive and/or electromagnetic transduction technology or technologies.

In some embodiments, transducer 102 is mechanically coupled to cymbal 101 such that it moves in concert with cymbal 101 when the cymbal is struck, and vibrations of cymbal 101 may be detected by transducer 102. In some embodiments, transducer 102 comprises an accelerometer, including but not limited to a capacitive accelerometer.

Transducer 102 may be positioned anywhere in relation to cymbal 101 such that acoustic waves resulting from a strike of the cymbal may be received by the transducer. For example, transducer 102 may not be mechanically coupled to cymbal 101 but may instead be located near the cymbal such that acoustic waves generated in the air by a strike of the cymbal are detected by the transducer. However, in the example of FIG. 1, transducer 102 is mechanically coupled to cymbal 101 via coupler 103. Coupler 103 may comprise any suitable means of attachment such that an acoustic signal generated by strike of cymbal 101 is detected by transducer 102. For example, coupler 103 may comprise a screw passed through a hole in cymbal 101.

In some embodiments, transducer 102 may be configured so as not to detect acoustic signals other than those generated by a strike of cymbal 101. For example, transducer 102 may be an accelerometer mechanically coupled to cymbal 101 and/or otherwise mechanically isolated so as to only detect motion of the cymbal.

When cymbal 101 is struck, an acoustic signal detected by transducer 102 may be used to identify the manner in which the cymbal was struck. For example, the acoustic signal detected by transducer 102 may identify a location of the strike on the cymbal and/or may indicate a force with which the cymbal was struck. In some embodiments, it may be beneficial for transducer 102 to have a wide bandwidth and high sensitivity so as to maximize the ability of the transducer to identify the manner in which cymbal was struck. As a non-limiting example, a suitable transducer may have a bandwidth of approximately 8 kHz (e.g., 100 Hz to 8 kHz), and/or may have a sensitivity between 1 mV/gn and 4 mV/gn.

Cymbal 101 may produce different types of vibrations (which may include sound waves in the air and/or vibrations of the cymbal itself) depending on where it is struck. While there are essentially infinite variations in the types of vibrations, for musical purposes cymbal strikes may be divided into at least three broad categories, including "bell", "bow", and "edge" strikes. Bell strikes are achieved by striking the cymbal near its center, on or around the bell or "cup" region, as illustrated in FIG. 8. Bow strikes are achieved by striking the main body of the cymbal with the tip of a stick. This "bow" region is illustrated in FIG. 8. Edge strikes are achieved by striking the edge of the cymbal with the side of a stick's shaft. In addition to the various strike types the cymbal may be silenced by grasping the edge of the cymbal (e.g., with a hand), causing vibrations to cease or to at least be significantly damped. This is referred to as "choking" the cymbal. The various strike types and choking are collectively referred to as the instrument's "articulations."

In some embodiments, when cymbal 101 is struck an acoustic signal detected by transducer 102 may be used to identify a cymbal articulation corresponding to the strike. For example, the acoustic signal may be used to identify a bell strike or an edge strike.

In some embodiments, cymbal 101 is configured to produce a low volume acoustic signal when struck. As discussed above, a low volume may aid in analysis of an acoustic signal generated by a strike of cymbal 101 and detected by transducer 102, since for example the acoustic signal may have a simpler form. In some embodiments, cymbal 101 may include a plurality of perforations which serve to reduce the volume of sounds generated by strike of the cymbal. Alternatively, or additionally, cymbal 101 may be coated with a resilient material, and/or a dampening element may be attached to cymbal 101, resulting in dampening of vibrations of the cymbal such that the volume and/or bandwidth resulting from a strike of the cymbal is reduced.

Figure 2A:
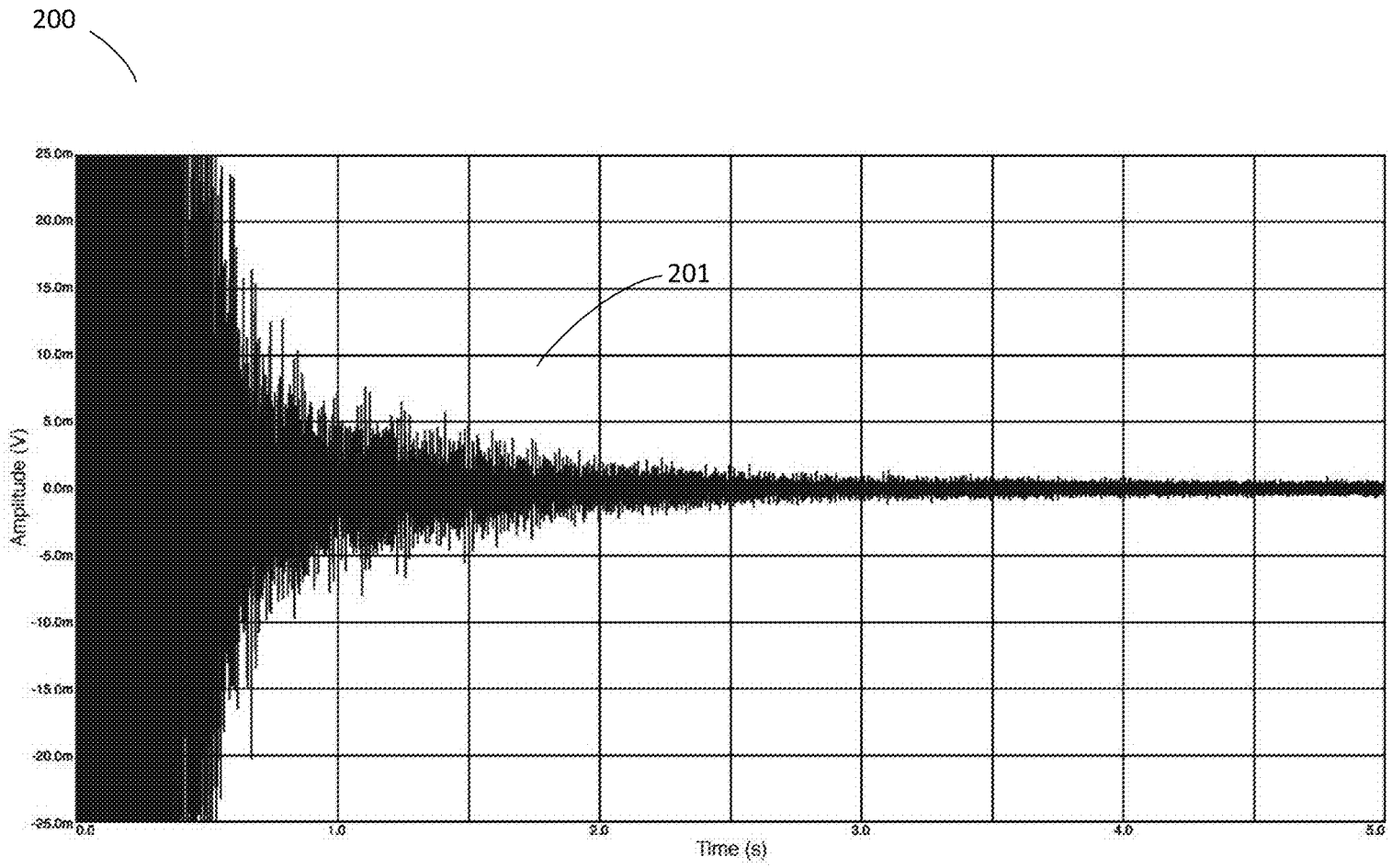
FIG. 2A illustrates an exemplary time-amplitude signal produced by an exemplary transducer that has detected a strike of a cymbal, according to some embodiments.

FIG. 2A illustrates an exemplary time-amplitude signal produced by an exemplary transducer that has detected a strike of an electronic cymbal as described herein, according to some embodiments. Plot 200 includes signal 201, in which time is shown on the horizontal axis and the amplitude is shown on the vertical axis. Signal 201 may have been detected by any suitable electronic cymbal as described herein, including any aspects of system 100 described above in relation to FIG. 1. It should be appreciated that the amplitude of signal 201 shown in FIG. 2A in the first 0.5 seconds exceeds the maximum amplitude displayed in the figure, but that the scale of FIG. 2A has been chosen to show the amplitude decay over several seconds, and accordingly the signal exceeds the displayed range in that part of the figure.

In FIG. 2A, a strike of the cymbal occurs at time zero. Accordingly, signal 201 represents the vibrations of a cymbal that is substantially free to vibrate, as can be seen by the fact that the amplitude of the vibrations of the cymbal are sustained for at least two seconds after the strike. In order for an electronic cymbal to detect a choke articulation (where a player has grasped the cymbal to stop vibrating), it may be beneficial for the cymbal to vibrate in the manner illustrated in FIG. 2A; that is, with a sustain lasting for a second or more. If the cymbal were otherwise to cease vibrating within a short window in the absence of a choke articulation (e.g., within 0.1 s or less), it would not be possible to identify an choke articulation since a player grasping the cymbal after a strike would have no effect on the vibrations, as they would likely have already decayed.

Figure 2B:
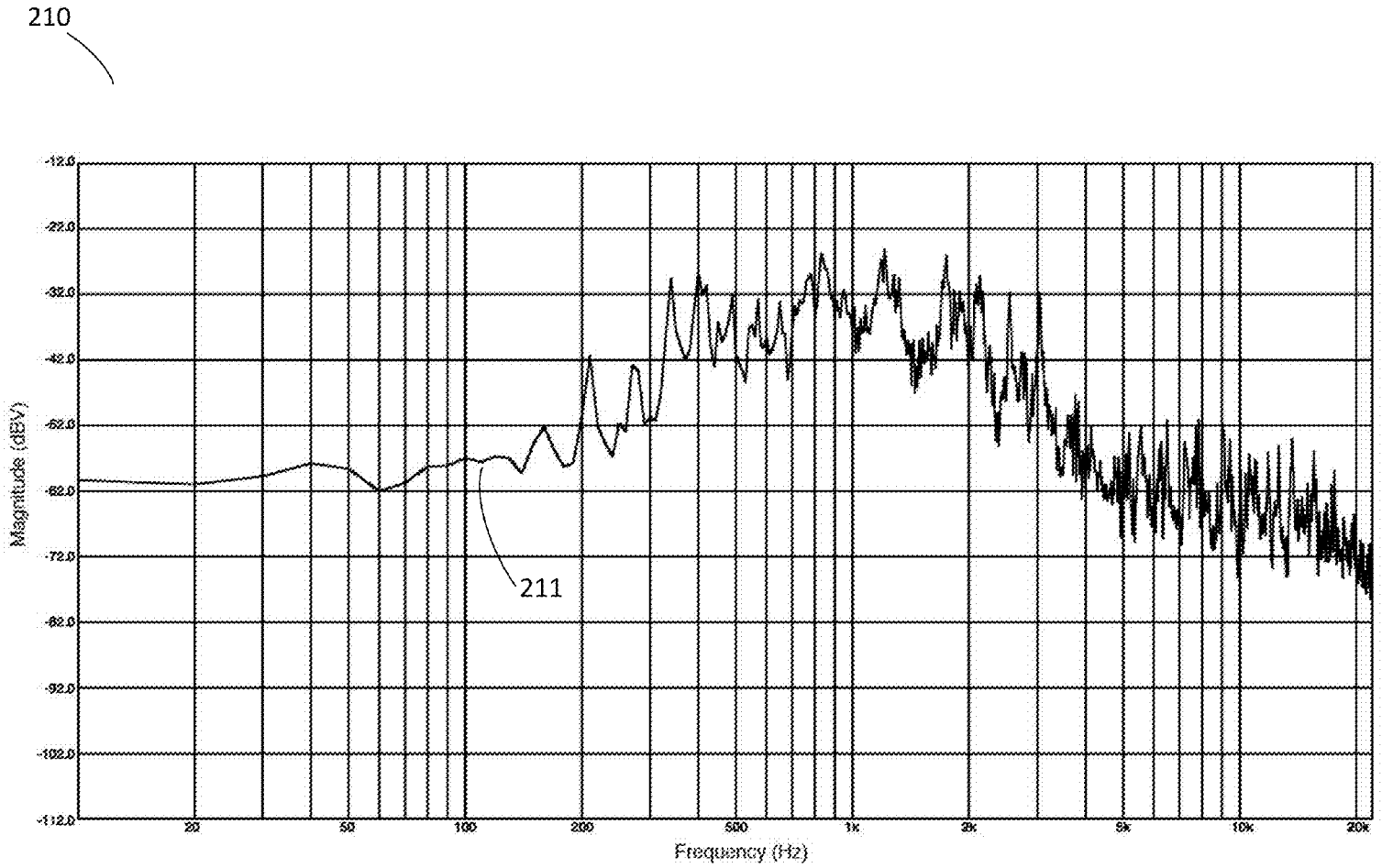
FIG. 2B illustrates an exemplary spectrogram corresponding to the exemplary time-amplitude signal shown in FIG. 2A, according to some embodiments.

FIG. 2B illustrates an exemplary spectrogram corresponding to the exemplary time-amplitude signal shown in FIG. 2A, according to some embodiments. Plot 210 includes signal 211, in which frequency is shown on the horizontal axis and a magnitude of the signal present at the corresponding frequency is shown on the vertical axis. Plot 210 and signal 211 illustrates that the strike of the cymbal shown in FIG. 2A includes frequencies of vibration from 200 Hz to 3 kHz and greater. The example signal shown in FIGS. 2A and 2B is included purely to demonstrate an exemplary response of an exemplary cymbal as measured by an exemplary transducer, and does not limit the response of an electronic cymbal described herein to any particular amplitude or frequency response.

In some embodiments, aspects of a time amplitude signal and/or a spectrogram, such as those shown in FIGS. 2A and 2B respectively, may be used to identify the manner in which an electronic cymbal was struck. For example, a high amplitude signal may indicate a harder strike of a cymbal compared with a lower amplitude signal. Alternatively, or additionally, the relative power distribution in particular frequencies of the signal may be used to distinguish between strikes at different points on the cymbal.

In some embodiments, aspects of a time-amplitude signal and/or a spectrogram, such as those shown in FIGS. 2A and 2B respectively, may be used to identify a cymbal articulation for a respective strike of the cymbal. For example a high amplitude strike may be indicative of a bell strike (a strike near the "cup") whereas a strike containing relatively high power in low frequencies may be indicative of an edge strike (a strike of the edge of the cymbal).

As discussed above, an electronic cymbal as described herein may incorporate perforations and/or a dampening coating and/or one or more dampening elements to reduce the volume of sound resulting from a strike of the cymbal. Thus, the amplitude shown in FIG. 2A may be comparatively reduced in such a cymbal.

Figure 3:
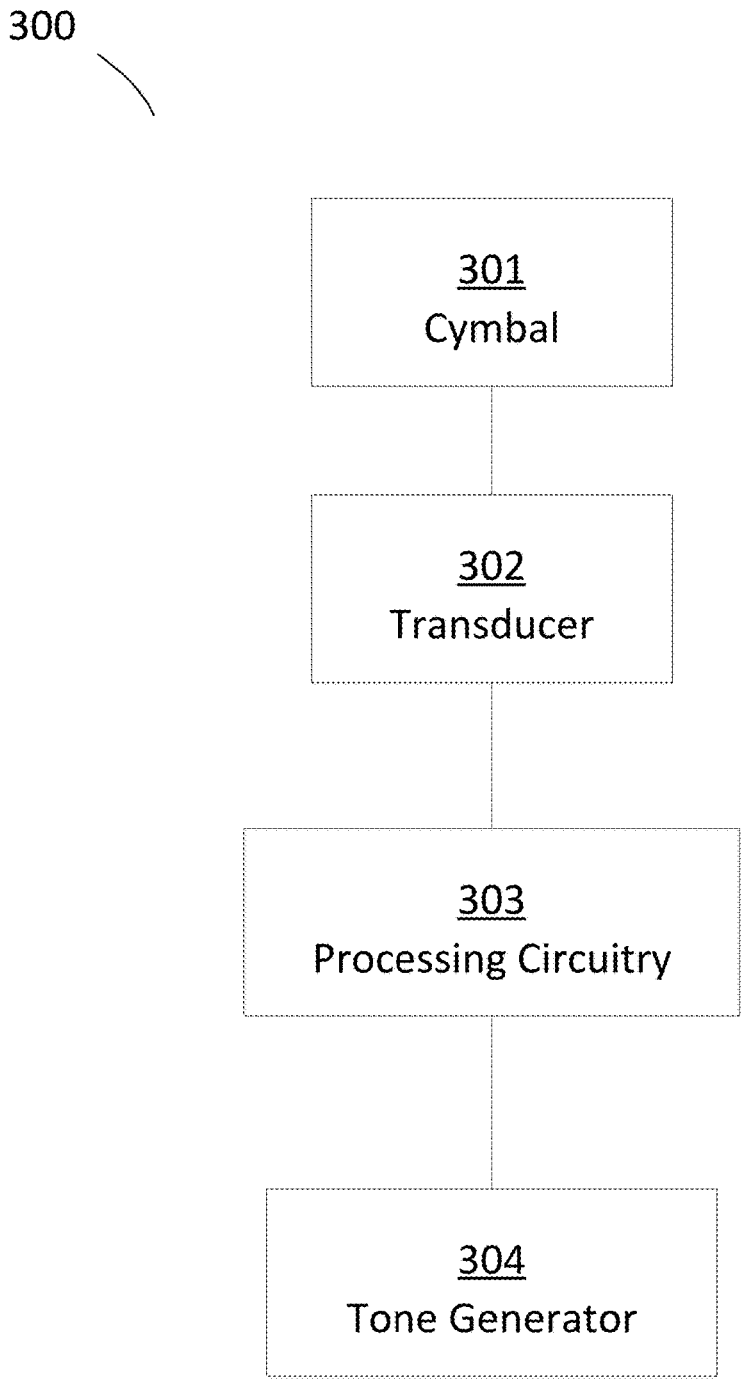
FIG. 3 illustrates a block diagram of an exemplary system for determining a manner in which a cymbal was struck and generating a tone corresponding to the determined strike, according to some embodiments.

FIG. 3 illustrates a block diagram of an exemplary system for determining a manner in which a cymbal was struck and for generating a tone corresponding to the determined strike, according to some embodiments. System 300 includes cymbal 301, transducer 302, processing circuitry 303 and tone generator 304.

Cymbal 301 may comprise any suitable cymbal as described herein, including any cymbal described above in relation to FIG. 1. Cymbal 301 is coupled to transducer 302. In some embodiments, cymbal 301 is mechanically coupled to transducer 302 such that an acoustic signal resulting from a strike of the cymbal is detected by the transducer. For example, transducer 302 may comprise an accelerometer and/or a piezoelectric element. In some embodiments, transducer 302 is coupled acoustically to cymbal 301 such that an acoustic signal produced by the cymbal is measured by the transducer. For example, transducer 302 may comprise a microphone.

Regardless of how transducer 302 is coupled to cymbal 301, the transducer is configured such that, when cymbal 301 is struck, the transducer detects an acoustic signal generated by the strike. Transducer 302 converts the detected acoustic signal into an electrical signal that represents one or more aspects of the acoustic signal generated by the cymbal strike. The electrical signal may comprise any suitable representation or representations of the acoustic signal, which may include any analog and/or digital representations. The electrical signal is sent from transducer 302 to processing circuitry 303. Transducer 302 and processing circuitry 303 may be enclosed within a single housing, or may be physically distinct elements of system 300 (though may be coupled together via physical means or otherwise).

Processing circuitry 303 determines a manner in which cymbal 301 was struck based on the electrical signal received from transducer 302. Processing circuitry 303 may make this determination in any suitable way, and by using any aspect or aspects of the received electrical signal. In some embodiments, one or more of the following aspects of the electrical signal are used: an amplitude, a frequency, a rise time, and/or combinations thereof. It will be appreciated, however, that in general any aspects, and any number of aspects, may be used to make a determination of a manner in which cymbal 301 was struck based on the electrical signal received from transducer 302. For example, a peak amplitude and an amplitude at a particular time after a strike of the cymbal (including at the time of the strike) may both be used to determine a manner in which the cymbal was struck. Alternatively, or additionally, more than one frequency may be identified, for example based on a power spectrum of the acoustic signal, and used to determine a manner in which the cymbal was struck. Furthermore, aspects of the electrical signal received from transducer 302 may be modified in any way and any number of times by processing circuitry 303 in determining a manner in which cymbal 301 was struck. For example, one or more aspects of the electrical signal may be transformed by processing circuitry 303 and an amplitude of a transformed signal may be used in determining a manner in which cymbal 301 was struck.

In some embodiments, processing circuitry 303 may perform attenuation of one or more frequency components of the electrical signal received from transducer 302, and may determine a manner in which cymbal 301 was struck based at least in part on an attenuated signal. For example, processing circuitry 303 may attenuate aspects of the electrical signal below a particular frequency (e.g., using a high pass filter) and use transmitted aspects of the electrical signal to determine a manner in which cymbal 301 was struck. Processing circuitry 303 may perform such an attenuation any number of times and using any suitable analog and/or digital components. As a non-limiting example, processing circuitry 303 may attenuate aspects of the electrical signal below a first frequency thus producing a first signal, and additionally may attenuate aspects of the electrical signal above a second frequency thus producing a second signal, and may use the first signal and/or the second signal in determining a manner in which cymbal 301 was struck. In some embodiments, processing circuitry 303 may perform attenuation of signals generated by one or more components of the processing circuitry.

The inventors have recognized and appreciated that by determining a manner in which cymbal 301 is struck based on an acoustic signal detected by transducer 302, a cymbal articulation corresponding to the strike may be identified by system 300. As non-limiting examples, it has been observed that an acoustic signal resulting from a bell strike may have a quickly rising amplitude, and may have a high peak amplitude; an acoustic signal resulting from a bow strike may have a quickly rising amplitude but may have a lower peak amplitude than a bell strike; an acoustic signal resulting from an edge strike may contain a significant low-frequency component; and an acoustic signal resulting from a choke may be recognized by a fast drop in amplitude. However, these are provided as examples only and in general any suitable aspects of an acoustic signal detected by transducer 302 may be used to identify any type of cymbal articulation, including the articulations noted above. Furthermore, it will be appreciated that circuitry to identify qualities of the electrical signal generated by transducer 302 may be created in any suitable way and may include any number of analog and/or digital components.

In some embodiments, processing circuitry 303 includes one or more analog components. For example, processing circuitry 303 may include one or more filters (including band pass, low pass, high pass, notch and/or roll-off filters), peak detectors, envelope detectors, operational amplifiers, analog-to-digital converters, digital to analog converters, and/or combinations thereof.

In some embodiments, processing circuitry 303 includes one or more digital components. For example, processing circuitry 303 may include one or more processors, one or more Application Specific Integrated Circuits (ASICs), one or more Field Programmable Gate Arrays (FPGAs), one or more microcontrollers, and/or combinations thereof. Processing circuitry 303 may include any number of interfaces configured to connect to external devices. For example, processing circuitry 303 may include one or more ports that may be connected to a computer or other device. Furthermore, processing circuitry 303 may include, or may have access to, any number of storage devices of any suitable type, including but not limited to RAM, ROM, Flash memory, hard disks, CD-ROMs, DVDs, Blu-rays discs, and/or combinations thereof.

Irrespective of how processing circuitry 303 determines a manner in which cymbal 301 was struck, processing circuitry 303 may provide one or more trigger signals as a result of the determination to tone generator 304. Trigger signals may be provided from processing circuitry 303 to tone generator 304 using any suitable communication technique. For example, trigger signals may be supplied via any wired communication technique, including but not limited to Universal Serial Bus (USB) and/or using a Musical Instrument Digital Interface (MIDI) interface; and/or may be supplied via any wireless communication technique, including but not limited to Wi-Fi and/or Bluetooth. Furthermore, the trigger signals may be provided in any suitable data format, such as MIDI and/or any suitable MIDI extension, such as General MIDI.

Tone generator 304 may store or otherwise have access to one or more stored sounds. Sounds stored by tone generator 304 may include any suitable sounds stored in any suitable format or formats. In some embodiments, tone generator 304 stores sounds corresponding to particular hits of a cymbal. For example, tone generator 304 may comprise and/or have access to one or more audio samples corresponding to bell strikes. However, in general, sounds stored by tone generator 304 may not be sounds of a cymbal and may be sounds of some other instrument or a non-instrument. Accordingly, while a user of system 300 may utilize tone generator 304 to produce sounds of a cymbal when cymbal 301 is struck, the system may additionally or alternatively be used to produce a different type of sound when cymbal 301 is struck.

Sounds stored by tone generator 304 may be stored in any suitable format. As non-limiting examples, sounds may be stored in one or more: wave files ("WAVs"), MPEG Audio files (including MPEG-1 or MPEG-2 Audio Layer 3, or "MP3" files), Pulse Code Modulation ("PCM") files, Advanced Audio Coding ("AAC"), and/or combinations thereof. Sounds may be furthermore stored in compressed (including lossy and/or lossless) and/or uncompressed formats.

Sounds stored by tone generator 304 may include sounds stored in any suitable memory device or memory devices coupled to tone generator 304, which may include one or more devices coupled via one or more wired and/or wireless connections, and/or may be included within the housing of tone generator 304. Suitable memory devices may utilize any volatile and/or non-volatile memory, including but not limited to RAM, ROM, Flash memory, hard disks, CD-ROMs, DVDs, Blu-rays discs, and/or combinations thereof.

In some embodiments, tone generator 304 comprises a drum module and may be configured to receive trigger signals from one or more devices, including other electronic cymbals. Tone generator 304 may be coupled to an amplifier and/or a speaker in order to output sounds based on received trigger signals. Alternatively, or additionally, tone generator 304 may output a digital audio signal in order to transfer or otherwise communicate a selected audio sample to another device.

A trigger signal provided by processing circuitry 303 to tone generator 304 may be delivered for any suitable length of time. In some embodiments, a trigger signal is provided for a length of time that depends on an analysis of the electrical signal by processing circuitry 303. For example, a cymbal strike having a long decay may result in a trigger signal being provided to tone generator 304 for a longer length of time than a cymbal strike with a relatively shorter decay. Accordingly, by receiving such a trigger signal the tone generator may generate a longer tone for a cymbal strike generating a correspondingly longer sound.

In some embodiments, tone generator 304 is configured to produce velocity controlled tones, wherein the volume of an audio sample to be produced by the tone generator may be defined by a velocity indication provided with or within a trigger signal provided to the tone generator. Processing circuitry 303 may produce a trigger signal in which one or more quantities have been scaled based on a volume determined by the processing circuitry that corresponds to a cymbal strike. For example, the trigger signal may include a voltage that is scaled based on a volume determined by processing circuitry 303.

In some embodiments, processing circuitry 303 may be coupled to more than one transducer. For example, a plurality of cymbals each coupled to a transducer may be coupled to processing circuitry 303. In such embodiments, processing circuitry 303 may include a plurality of channels, each channel corresponding to a coupled transducer, via which trigger signals are provided to tone generator 304. Accordingly, a plurality of cymbals may share processing circuitry 303 and tone generator 304, while a trigger signal corresponding to each of the plurality of cymbals may be provided independently from processing circuitry 303 to tone generator 304.

Transducer 302 and/or processing circuitry 303 may be coupled to one or more switches whose position affects the detection of an acoustic signal by transducer 302 and/or the processing of an electrical signal by processing circuitry 303. For example, transducer 302 may produce an electrical signal based at least in part on the position of a switch, such as by adjusting the amplitude and/or frequency response of the transducer based on said position.

Alternatively, or additionally, processing circuitry 303 may perform an analysis of a manner in which cymbal 301 was struck based at least in part on the position of a switch. In some embodiments, a switch indicates a type of cymbal to which transducer 302 and/or processing circuitry 303 is coupled. For example, a suitable switch may have one or more settings indicating that an associated cymbal is a ride cymbal, a crash cymbal, and/or a hi-hat. In such embodiments, processing circuitry 303 may identify a cymbal articulation based at least in part on the cymbal type currently selected by the switch. Such a switch may be provided in any suitable location, such as on a housing coupled to transducer 302, and/or a housing coupled to processing circuitry 303.

In some embodiments, processing circuitry 303 may determine a manner in which cymbal 301 was struck based at least in part on one or more variables defined by a user. Such variables may be related to the type of cymbal 301, and/or may represent playing preferences expressed by the user. In some embodiments, such variables may be input to processing circuitry 303 using any suitable interface to which the processing circuitry is coupled, including but not limited to an attached computer. Alternatively or additionally, such user-defined variables may be stored in a storage device coupled to, or otherwise accessible to, processing circuitry 303.

In some embodiments, processing circuitry 303 may perform masking of an electrical signal received from transducer 302. It may be beneficial in some use cases to ignore aspects of the electrical signal received from transducer 302 (to "mask" the signal) that indicate a cymbal strike has occurred if this happens within a particular time period after a previous cymbal strike has been identified. For example, it may be beneficial to ignore an identification of a cymbal strike if it occurs less than 20 ms after the previous identification of a cymbal strike.

In some embodiments, a masking time period may depend on the physical characteristics of cymbal 301 (e.g., size, shape and/or relative size of cup and bow, etc.) and/or may depend on an identified manner in which the cymbal was struck (e.g. a cymbal articulation). For example, a masking time period for a bell strike may be greater than that for a bow strike. As non-limiting examples, masking periods for the following cymbal articulations may be used: bow strike=35 ms, bell strike=120 ms, and edge strike=50 ms.

In some embodiments, processing circuitry 303 may be configured to perform one or more periodic actions. As non-limiting examples, programming circuitry 303 may be configured to examine a masking timer to determine whether a period in which the identification of cymbal strikes is being ignored should end; to analyze whether a choke articulation has occurred; and/or to determine whether a trigger being output to tone generator 304 for a particular length of time should be ceased.

In some embodiments, processing circuitry 303 may perform digital sampling of an electrical signal received from transducer 302, and/or may perform digital sampling of signals derived from the electrical signal. Such digital sampling may be performed at any suitable sampling rate, including but not limited to 20 kHz, 44.1 kHz, 48 kHz, and/or 96 kHz. Furthermore digital sampling formed by processing circuitry 303 may utilize any suitable modulation techniques, including Pulse Code Modulation (PCM), and/or may use any suitable bit depth, including but not limited to 8-bit, 16-bit and/or 24-bit.

In some embodiments, processing circuitry 303 may incorporate one or more timers. Such timers may be implemented using any suitable hardware and/or software techniques. Timers may be used to track aspects of an electrical signal received from transducer 302 over a time window, for example to determine an average amplitude level over a time window. Alternatively or additionally, a timer may be used to wait for a particular event in order to form an analysis of an electrical signal received from transducer 302. For example, a timer may be used to wait for an aspect of the electrical signal received from transducer 302 to reach a peak level, such as waiting for an amplitude to reach a maximum value in order to determine a volume corresponding to a cymbal strike.

In some embodiments, processing circuitry 303 may store, or otherwise have access to, one or more threshold values, any number of which may be used in determining a manner in which cymbal 301 was struck. Threshold values may correspond to, for example, amplitude thresholds that may be used in identifying a cymbal articulation corresponding to a strike of cymbal 301. As a non-limiting example, an amplitude above which a signal may be identified as corresponding to a bell strike of cymbal 301 may differ from amplitude above which a signal may be identified as corresponding to a bow strike.

In some embodiments, the magnitude of one or more threshold values used by processing circuitry 303 may depend on one or more characteristics of cymbal 301 and/or transducer 302. For example, the type of cymbal 301 (e.g., a crash cymbal or a ride cymbal) may be determinative of one or more threshold values. This may, for example, allow for identification of a cymbal articulation to be tailored to a particular type of cymbal (e.g., a threshold relating to identification of an edge strike on a ride cymbal may differ from a threshold relating to identification of an edge strike on a crash cymbal). Alternatively, or additionally, one or more characteristics of transducer 302 may be determinative of one or more threshold values, for example a gain of the transducer. Irrespective of how one or more threshold values used by processing circuitry 303 may depend on one or more characteristics of cymbal 301 and/or transducer 302, such threshold values may be effected in any suitable way, including by providing the values to processing circuitry 303 from a device coupled to the processing circuitry, and/or by processing circuitry 303 accessing a suitable storage device.

In some embodiments, processing circuitry 303 may determine a manner in which cymbal 301 was struck by identifying a zone in which the cymbal was struck. The zones may be physical regions of cymbal 301 (e.g., the bow region) and/or may be conceptual ways in which the cymbal may be struck (e.g., hard versus soft strikes). For example, processing circuitry 303 may identify whether a cymbal was struck in a bell zone or whether the cymbal was struck along an edge. In such an example, processing circuitry 303 may be configured to identify a manner in which the cymbal was struck based on this "two zone" approach, that is to determine, for a strike, which of the two zones generated the strike. In general, however, processing circuitry 303 may be configured to identify a manner in which cymbal 301 was struck based on any number and any type of zones, and furthermore may be configured to perform multiple such analyses (e.g., to perform a two zone analysis in addition to a three zone analysis).

In some embodiments, one or more zones may correspond to a cymbal articulation. For example, a two zone algorithm may determine whether a strike of cymbal 301 should be identified as corresponding to a bell strike or an edge strike. In some embodiments, processing circuitry 303 may be configured to select a zone-based analysis of a cymbal strike based on characteristics of cymbal 301, such as a type of the cymbal. For example, processing circuitry 303 may be configured to perform a three zone analysis when cymbal 301 is a ride cymbal and to perform a two zone analysis when cymbal 301 is a hi-hat.

The inventors have recognized and appreciated that after a strike of cymbal 301, the manner in which the cymbal was struck may not, in some use cases, be immediately determined. However, to delay analysis of an electrical signal provided from transducer 302 to processing circuitry 303 until the manner in which cymbal 301 was struck is determined may introduce an audible delay in sounds produced by tone generator 304. For example, in some use cases different types of cymbal strikes may be indistinguishable for a short period after a strike. The inventors have recognized and appreciated that in such cases it may be beneficial to produce a first identification of a manner in which cymbal 301 was struck, and then if it is subsequently determined that in fact cymbal 301 was struck in a different manner, to produce a second identification afterwards.

As a non-limiting example of the above, in some cases an edge strike may be indistinguishable from a bell or bow strike for 20-30 ms after the strike. However, to delay analysis of an electrical signal received from transducer 302 until the correct strike is identified, and/or to delay the production of a trigger provided to tone generator 304, may cause a delay in tone generator 304 producing a tone, which may be noticed by a user of system 300. Accordingly, a bell or bow strike trigger may be immediately generated and provided to tone generator 304. Then, if it is subsequently determined that the strike was an edge strike, an edge trigger may be generated and provided to tone generator 304. If the time between the consecutive triggers is sufficiently short (e.g. less than approximately 50 ms), the user of system 300 will not notice sound resulting from the first trigger; rather, to the user it will appear simply as if a tone corresponding to an edge trigger were generated.

In some embodiments, one or more cymbal articulations may be identified and/or ruled out based on analysis of an attenuated signal. For example, processing circuitry 303 may identify and/or rule out one or more cymbal articulations based on a signal derived from an electrical signal provided from transducer 302 to which one or more attenuation operations have been performed. High frequency aspects of the electrical signal may, in some use cases, provide information to aid in identification of a cymbal articulation that is useful over and above the original electrical signal and/or low frequency aspects of an electrical signal. Accordingly, identification of a cymbal articulation may be based on one or more high frequency aspects and/or low frequency aspects of an electrical signal provided from transducer 302 to processing circuitry 303.

As a non-limiting example, an edge strike may be identified, at least in part, by detecting an amplitude of high frequency aspects of an electrical signal received from transducer 302 lower than a comparative amplitude of high-frequency aspects of the electrical signal that would be detected in a bow strike or a bell strike. In particular, an amplitude of high-frequency aspects at the time that a strike of cymbal 301 occurs may aid in distinguishing an edge strike from a bow strike or a bow strike. Whether an amplitude of high-frequency aspects of the electrical signal indicates an edge strike or a bow/bell strike may be determined by comparing the amplitude with a suitable threshold value. In this example, "high-frequency" may include any suitable frequency band, such as frequencies above between 300-600 Hz, for example, frequencies above 500 Hz.

As another non-limiting example, a bell strike may be distinguished from a bow strike by examining an amplitude of high-frequency aspects of an electrical signal received from transducer 302 in addition to an amplitude of low-frequency aspects of the electrical signal, both at (or close to, e.g., within a few milliseconds of) the time of a strike of cymbal 301. In particular, a high amplitude of high-frequency aspects in addition to a high amplitude of low-frequency aspects may together indicate a bell strike. Whether an amplitude of high-frequency aspects of the electrical signal is consistent with a bell strike may be determined by comparing the amplitude of high-frequency aspects with a suitable first threshold value, and/or whether an amplitude of low-frequency aspects of the electrical signal is consistent with a bell strike may be determined by comparing the amplitude of low-frequency aspects with a suitable second threshold value. Accordingly, a bell strike may be identified by determining that both the amplitude of the low-frequency aspects and the amplitude of the high-frequency aspects are above their respective threshold values. In this example, "high-frequency" may include any suitable frequency band, such as frequencies above between 300-600 Hz, for example, frequencies above 500 Hz; and "low-frequency" may include any suitable frequency band, such as frequencies below between 300-600 Hz, for example, frequencies below 400 Hz.

Figure 4A:
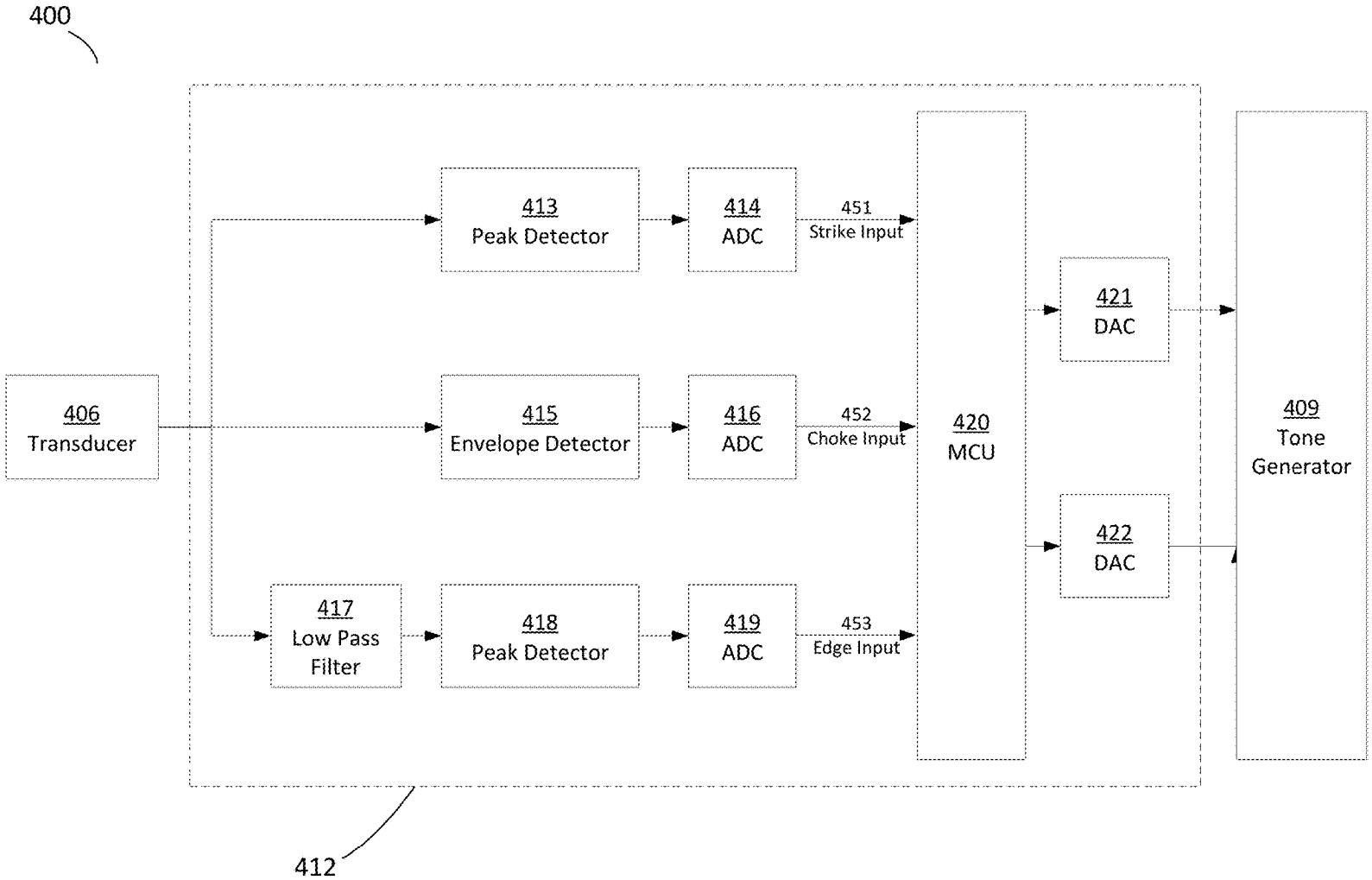
FIG. 4A illustrates a block diagram of an exemplary system for determining a manner in which a cymbal was struck, and for generating a tone based on the determination, according to some embodiments.

FIG. 4A illustrates a block diagram of an exemplary system for determining a manner in which a cymbal was struck, and for generating a tone based on the determination, according to some embodiments. System 400 may depict aspects of system 300 shown in FIG. 3, wherein a particular group of analog and digital components are used in processing circuitry 303. In the example of FIG. 4A, one or more of peak detector 413, envelope detector 415, low pass filter 417, peak detector 418 and microcontroller 420 may be used, at least in part, to identify a cymbal articulation resulting from a strike of a cymbal (not shown) coupled to transducer 406.

Transducer 406 is coupled to a cymbal (not shown) and detects an acoustic signal generated by strike of the cymbal. Detection of the acoustic signal may be performed in any way as described here in, including the techniques described above in relation to FIG. 3. Transducer 406 generates an electrical signal that is provided to processing circuitry 412, which provides the signal to peak detector 413, envelope detector 415 and low pass filter 417. Transducer 406 may be coupled to any suitable cymbal, including a cymbal having any properties or combination of properties discussed above in relation to cymbal 101 shown in FIG. 1.

Peak detector 413 extracts one or more amplitude peaks from the electrical signal received from transducer 406 and provides the resulting signal(s) to analog-to-digital converter (ADC) 414. For example, peak detector 413 may be configured to provide an indication of one or more maximum amplitudes within one or more time windows to ADC 414. Peak detector 413 may comprise any suitable analog component or components such that a peak amplitude during a time window may be identified. ADC 414 digitizes the received signal(s).

Irrespective of how the output of peak detector 413 is generated, the digital output of ADC 414 is sent to microcontroller 420 as an indication of whether a strike of a cymbal coupled to transducer 406 has occurred. Since a strike of the cymbal may generate a higher amplitude signal in transducer 406 than would be detected in the absence of a strike, a peak amplitude detected by peak detector 413 may be used to identify whether a strike of the cymbal has occurred and/or a manner in which the cymbal was struck.

Envelope detector 415 extracts an average amplitude during a time window from the electrical signal provided by transducer 406, and provides an indication of the average amplitude to ADC 416. Envelope detector 415 may comprise any suitable analog component or components such that a maximum amplitude of the electrical signal received from transducer 406 during a time window is identified. The time window used by envelope detector 415 may be effected in any suitable way, including by storing one or more values identifying the time window in a storage device coupled to, or otherwise accessible by, envelope detector 415, and/or by configuring the circuitry of envelope detector 415 to make use of a particular time window (e.g., using wiring and/or circuit components). The time window used by envelope detector 415 may be of any suitable length, such as between 1 ms and 500 ms. ADC 416 digitizes a signal or signals received from envelope detector 415.

Irrespective of how the output of envelope detector 415 is generated, the digital output of ADC 416 is sent to microcontroller 420 as an indication of whether a choke of the cymbal coupled to transducer 406 has occurred. Since envelope detector 415 may identify an average amplitude over a time period, the rate of change of this average amplitude may be used to identify whether a fast drop in amplitude has occurred, such as may occur during a choke of the cymbal.

Low pass filter 417 filters particular frequencies of the electrical signal received from transducer 406 and provides the resulting signal to peak detector 418. Low pass filter 417 may comprise any suitable analog component or components, and may perform filtering in any suitable manner such that frequencies present in the electrical signal received from transducer 406 below a first frequency are transmitted and frequencies above a second frequency are not transmitted. For example, low pass filter 417 may transmit all frequencies below a cutoff frequency and filter all frequencies above that cutoff frequency. Low pass filter 417 may comprise any suitable analog component or components such that the filtering operation described above may be performed.

In the example of FIG. 4A, low pass filter 417 may utilize any suitable frequency or frequencies in performing filtering. For example, low pass filter 417 may transmit frequencies below 600 Hz and filter frequencies at or above 600 Hz. In some embodiments, one or more frequencies utilized by low pass filter 417 are based upon one or more physical characteristics of a cymbal coupled to transducer 406. For example, a frequency utilized by low pass filter 417 may depend on a size and/or a shape of the cymbal. A frequency used by low pass filter 417 may be effected in any suitable way, including by storing one or more values identifying the frequency in a storage device coupled to, or otherwise accessible by, low pass filter 417, and/or by configuring the circuitry of low pass filter 417 to make use of a particular frequency (e.g., using wiring and/or circuit components).

Peak detector 418 extracts amplitude peaks from the electrical signal received from transducer 406 and provides the resulting signal to ADC 419. For example, peak detector 418 may be configured to provide an indication of a maximum amplitude within a time window to ADC 419. Peak detector 418 may comprise any suitable analog component or components such that the peak amplitude during a time window may be identified. ADC 419 digitizes a signal or signals received from peak detector 418.

Irrespective of how the output of peak detector 418 is generated, the digital output of ADC 419 is sent to microcontroller 420 as an indication of whether an edge strike of the cymbal coupled to transducer 406 has occurred. Since an edge strike of the cymbal may generate a higher amplitude signal in transducer 406 than would be detected in the absence of a strike and may comprise a substantial low frequency response, the peak amplitude detected by peak detector 418 (which was provided to the peak detector by low pass filter 417) may be used to identify whether an edge strike of the cymbal has occurred.

In embodiments in which peak detectors 413 and/or 418 determine a peak amplitude during a time window, the size of the time window(s) may be effected in any suitable way, including by storing one or more values identifying one or more time windows in a storage device coupled to, or otherwise accessible by, peak detectors 413 and/or 418, and/or by configuring the circuitry of peak detectors 413 and/or 418 to make use of a particular time window value or values (e.g., using wiring and/or circuit components). Peak detector 413 and peak detector 418 may utilize the same or different time windows in determining a peak amplitude.

The outputs of ADCs 414, 416 and 419 are provided as inputs to microcontroller 420. ADCs 414, 416 and 419 may perform conversions of the analog signals received from peak detector 413, envelope detector 415 and peak detector 418, respectively, in any suitable way and using any suitable components. In particular, the digital sampling interval of ADCs 414, 416 and 419 may be any suitable value, such as between 1 kHz and 1 MHz; for example 20 kHz. Furthermore, digital sampling performed by ADCs 414, 416 and 419 may utilize any suitable modulation techniques, including Pulse Code Modulation (PCM), and/or may use any suitable bit depth, including but not limited to 8-bit, 16-bit and/or 24-bit. ADCs 414, 416 and 419 may, or may not, utilize the same digital sampling intervals, modulation techniques, and/or bit depths.

Microcontroller 420 is configured to identify a cymbal articulation corresponding to a strike of a cymbal coupled to transducer 406 based at least in part on one or more of inputs 451, 452 and 453. Microcontroller 420 may identify the cymbal articulation using any suitable techniques and may be programmed in any suitable fashion. It will be appreciated that based on the information provided by inputs 451, 452 and 453, there are many ways in which a microcontroller may be programmed to determine a cymbal articulation based on these inputs, and the example of FIG. 4A is not limited to any particular such way.

In some embodiments, microcontroller 420 is configured to compare one or more of inputs 451, 452 and 453 with one or more threshold values to determine whether a cymbal strike has occurred and/or to determine a manner in which the cymbal was struck. For example, microcontroller 420 may compare input 451 with an amplitude representing a threshold for a bell strike and/or with an amplitude representing a threshold for a bow strike in order to determine which of these types of strike, if any, occurred.

Irrespective of how microcontroller 420 identifies one or more cymbal articulations, when an articulation has been identified, an output signal is provided from microcontroller 420 to digital-to-analog converters (DACs) 421 and/or 422, which convert the digital signals from microcontroller 420 to analog signals, which are provided to tone generator 409. In some embodiments, DACs 421 and 422 generate output signals that correspond to tip and ring signal connections provided to tone generator 409. For example, a cable connecting processing circuitry 412 may provide a tip signal and a ring signal to tone generator 409, and DACs 421 and 422 may each output one of these two signals to the cable.

In some embodiments, microcontroller 420 may be configured to provide one or more output signals based on the configuration of tone generator 409. For example, tone generator 409 may be a drum module, and microcontroller 420 may output one or more signals corresponding to one or more strikes of a cymbal coupled to transducer 406 based on the particular drum module being used.

In some embodiments, a voltage of a signal provided to tone generator 409 is scaled based on an analysis performed by microcontroller 420. For example, the volume of a cymbal strike may be determined by microcontroller 420 and used to provide a velocity-scaled signal to tone generator 409 by scaling the voltage of the signal based on the determined volume.

Each of the components illustrated in the example of FIG. 4A may be provided using any suitable circuitry, and may be located on any number of physical circuits and/or chips. For example, one or more (including all) of the components of system 400 may be included in one or more ASICs. Moreover, signals provided between components may be provided using any suitable wired and/or wireless techniques.

Figure 4B:
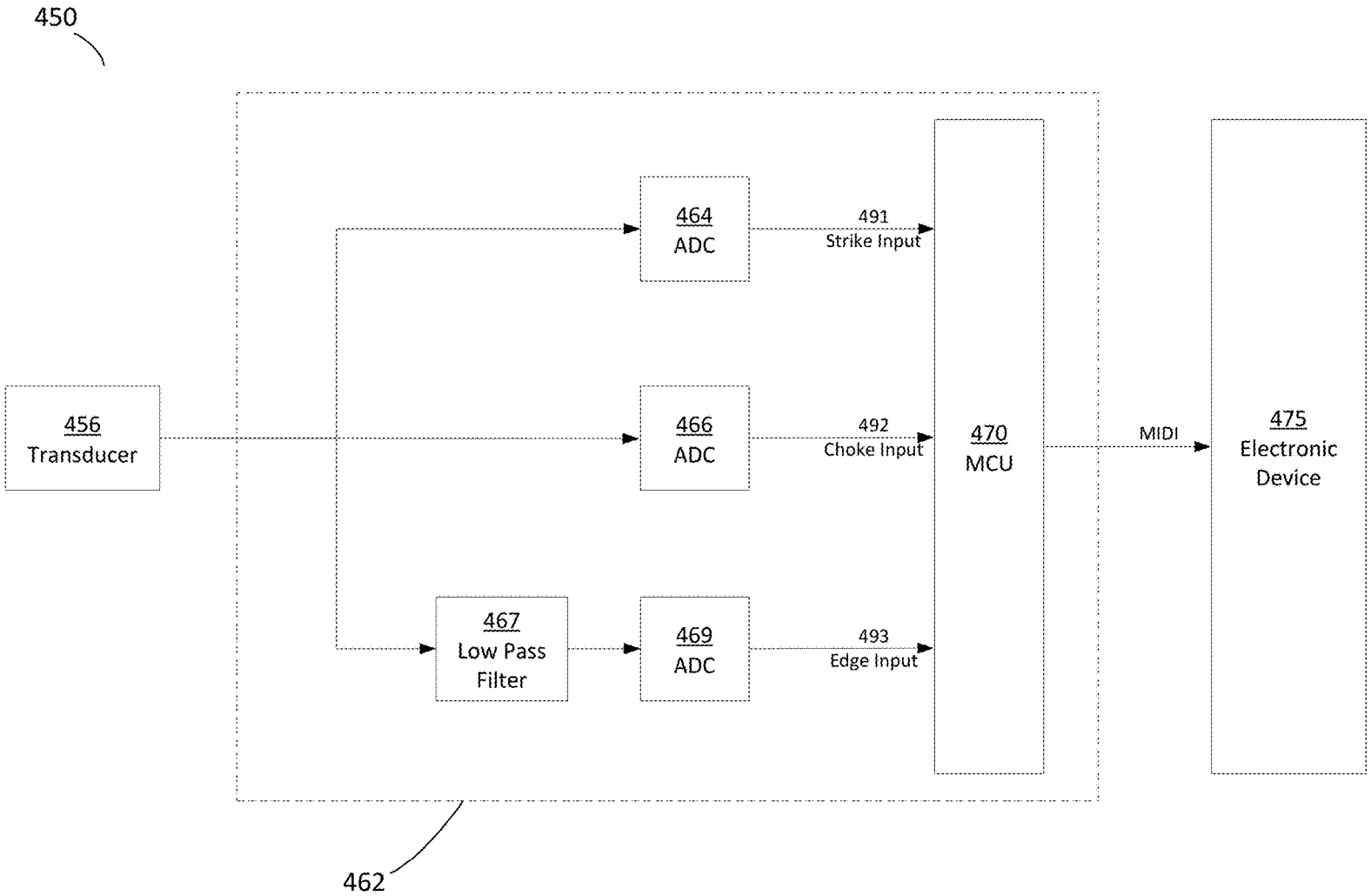
FIG. 4B illustrates a block diagram of an exemplary system for determining a manner in which a cymbal was struck, and for providing a MIDI signal based on the determination, according to some embodiments.

FIG. 4B illustrates a block diagram of an exemplary system for determining a manner in which a cymbal was struck, and for providing a MIDI signal based on the determination, according to some embodiments. System 450 may depict aspects of system 300 shown in FIG. 3, wherein a particular group of analog and digital components are used in processing circuitry 303. As discussed above, trigger signals provided to tone generator 304 may comprise MIDI signals. FIG. 4B illustrates some embodiments in which a transducer detects an acoustic signal generated by strike of a cymbal and generates a MIDI signal, which is provided to an electronic device.

System 450 includes transducer 456 and components 464, 466, 467 and 469, which may include any of the corresponding components having features described above in relation to FIG. 4A (i.e., transducer 406 and components 414, 416, 417 and 419, respectively). In addition, microcontroller 470 provides a MIDI signal to electronic device 475. In the example of FIG. 4B, the functions of peak detector 413, envelope detector 415 and peak detector 418 described above are performed by microcontroller 470.

Electronic device 475 may include any suitable device able to receive MIDI signals. Non-limiting examples include a MIDI controller, a sequencer (including hardware and/or software), a MIDI instrument (e.g., a drum machine, a sampler, a keyboard, etc.), and/or combinations thereof.

Each of the components illustrated in the example of FIG. 4B may be provided using any suitable circuitry, and may be located on any number of physical circuits and/or chips. For example, one or more (including all) of the components of system 450 may be included in one or more ASICs. Moreover, signals provided between components may be provided using any suitable wired and/or wireless techniques.

FIGS. 5A-5E illustrate exemplary oscilloscope traces depicting one or more of the inputs to microcontroller 420 shown in FIG. 4A, according to some embodiments. The oscilloscope traces illustrated in FIGS. 5A-5E are provided to illustrate some non-limiting ways in which inputs to microcontroller 420 shown in FIG. 4A may be used to identify a cymbal articulation. In each of FIGS. 5A-5E, time is shown on the horizontal axis and the amplitude of signals illustrated therein is shown on the vertical axis.

Figure 5A:
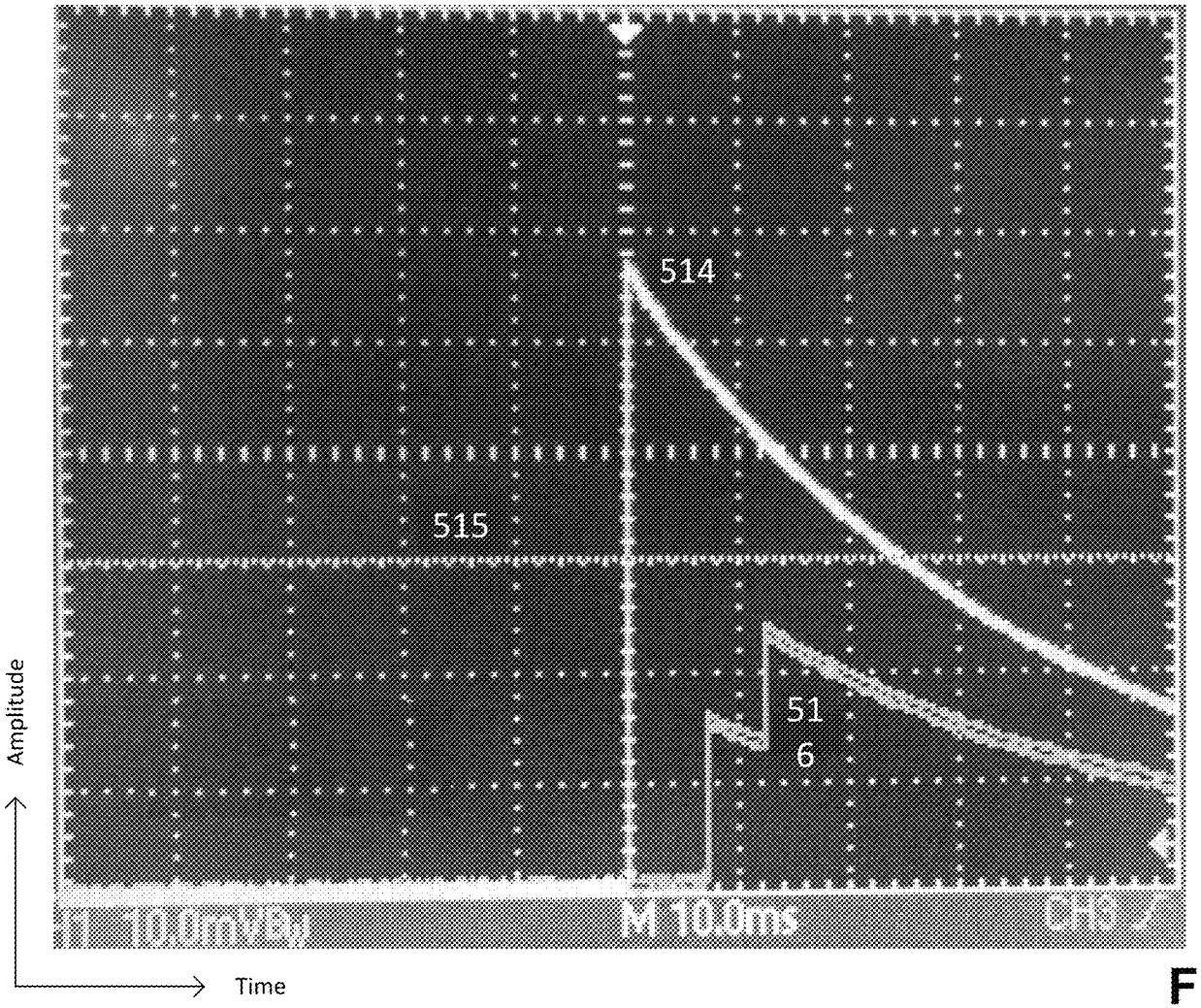
FIG. 5A illustrates an exemplary oscilloscope trace depicting a bell strike of a cymbal, according to some embodiments.

FIG. 5A illustrates an exemplary oscilloscope trace depicting a bell strike of a cymbal, according to some embodiments. Signal 514 indicates a level of strike input 451 shown in FIG. 4A (and/or strike input 491 shown in FIG. 4B), and signal 516 indicates a level of edge input 453 shown in FIG. 4A (and/or edge input 493 shown in FIG. 4B). Signal 515 illustrates an exemplary threshold level that may be compared with signals 514 and/or 516 in order to determine a type of cymbal articulation corresponding to the cymbal strike. In the example of FIG. 5A, it will be seen that strike input level 514 exceeds threshold level 515, while the low-frequency edge input level 516 does not, due to the relatively low low-frequency content of a bell strike. This strike may thereby be identified as a bell strike.

Figure 5B:
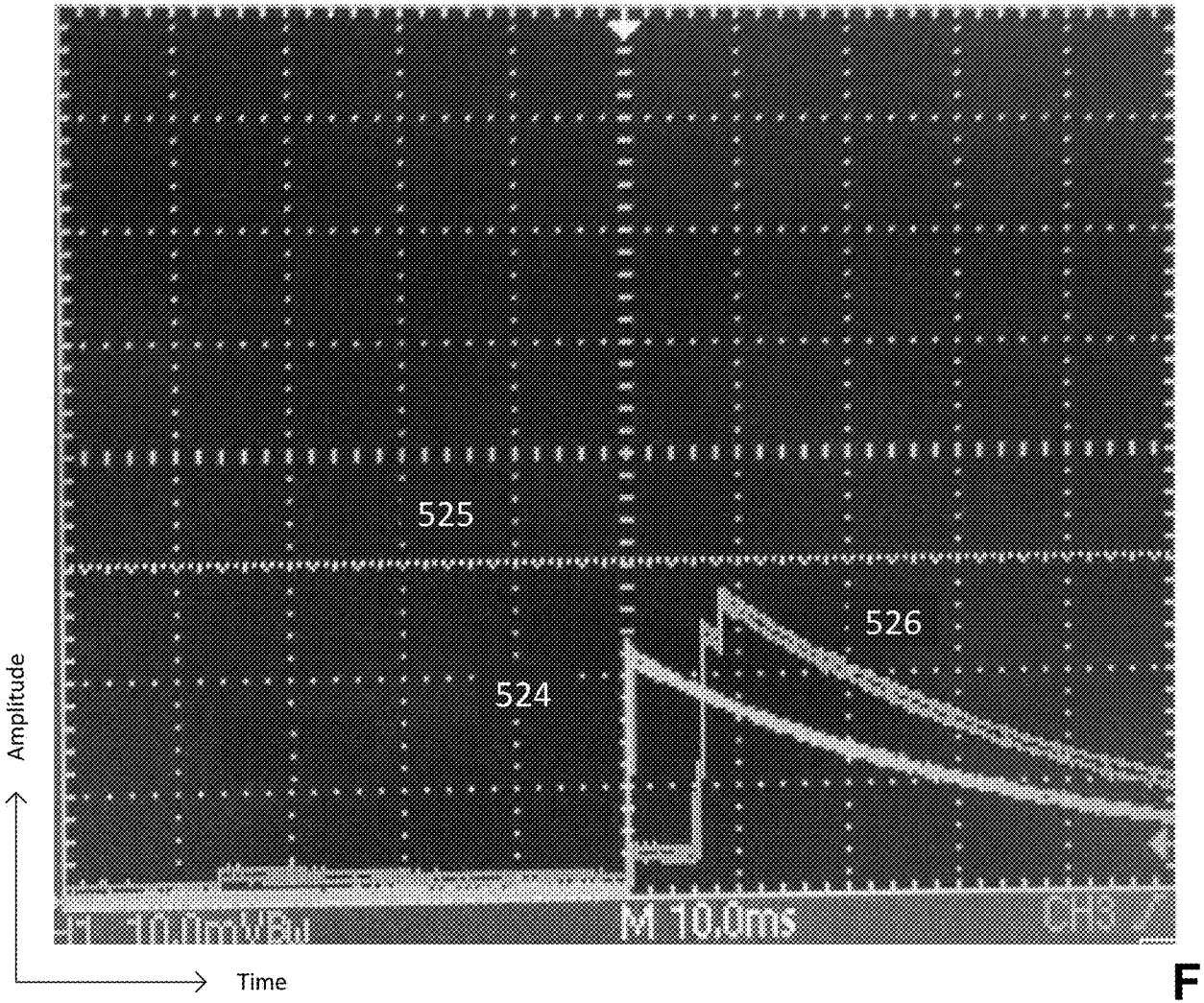
FIG. 5B illustrates an exemplary oscilloscope trace depicting a bow strike of a cymbal, according to some embodiments.

FIG. 5B illustrates an exemplary oscilloscope trace depicting a bow strike of a cymbal, according to some embodiments. Signal 524 indicates a level of strike input 451 shown in FIG. 4A (and/or strike input 491 shown in FIG. 4B), and signal 526 indicates a level of edge input 453 shown in FIG. 4A (and/or edge input 493 shown in FIG. 4B). Signal 525 illustrates an exemplary threshold level that may be compared with signals 524 and/or 526 in order to determine a type of cymbal articulation corresponding to the cymbal strike. In the example of FIG. 5B, it will be seen that neither strike input level 524 nor edge input level 526 exceed threshold level 525, due to the relatively low energy imparted by a stick tip during a bow strike. This strike may thereby be identified as a bow strike.

Figure 5C:
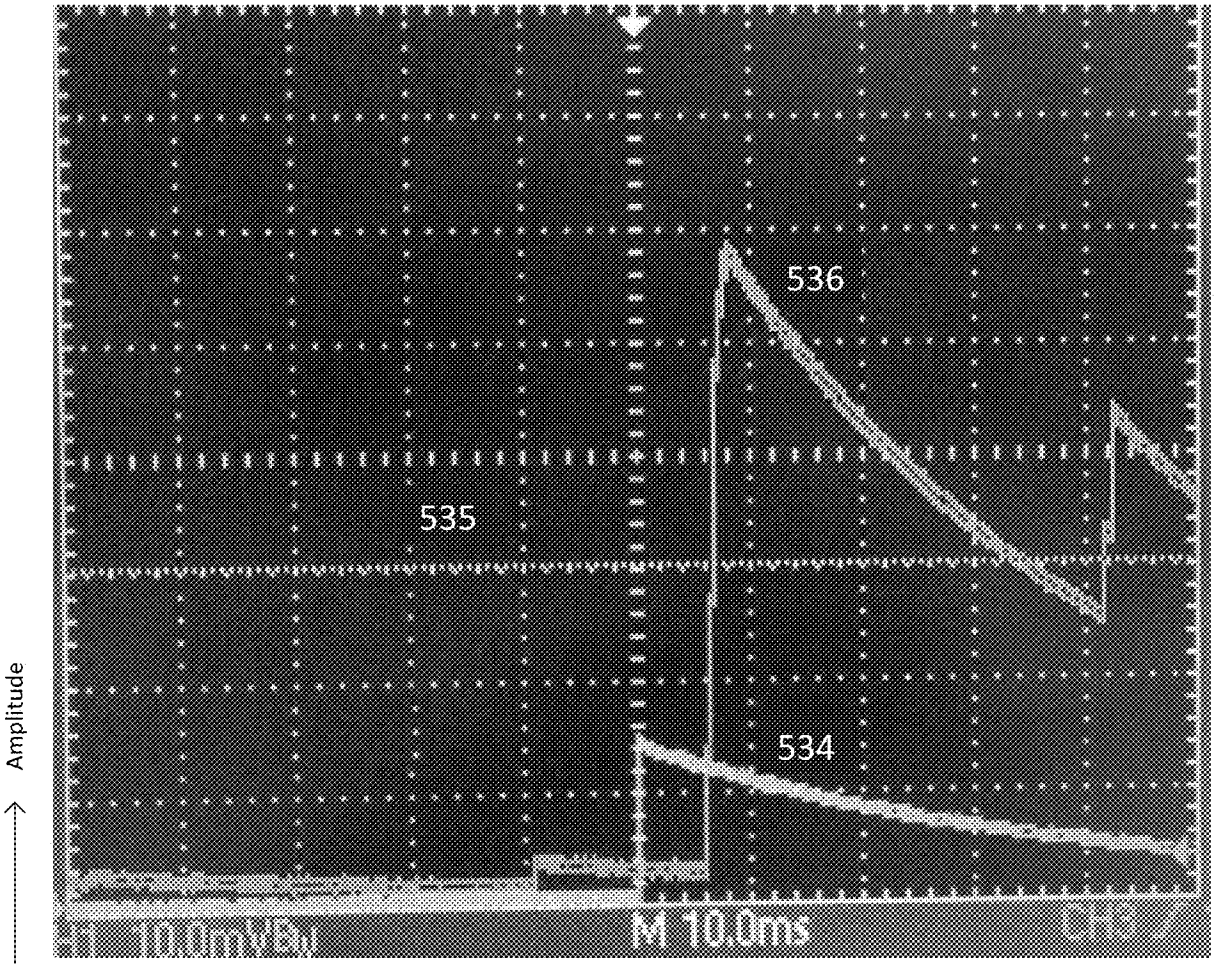
FIG. 5C illustrates an exemplary oscilloscope trace depicting an edge strike of a cymbal, according to some embodiments.

FIG. 5C illustrates an exemplary oscilloscope trace depicting an edge strike of a cymbal, according to some embodiments. Signal 534 indicates a level of strike input 451 shown in FIG. 4A (and/or strike input 491 shown in FIG. 4B), and signal 536 indicates a level of edge input 453 shown in FIG. 4A (and/or edge input 493 shown in FIG. 4B). Signal 535 illustrates an exemplary threshold level that may be compared with signals 534 and/or 536 in order to determine a type of cymbal articulation. In the example of FIG. 5A, it will be seen that low-frequency edge input level 536 exceeds threshold level 535, while the strike input level 534 does not, due to the relatively large amount of low-frequency energy generated by an edge strike. This strike may thereby be identified as an edge strike.

Figure 5D:
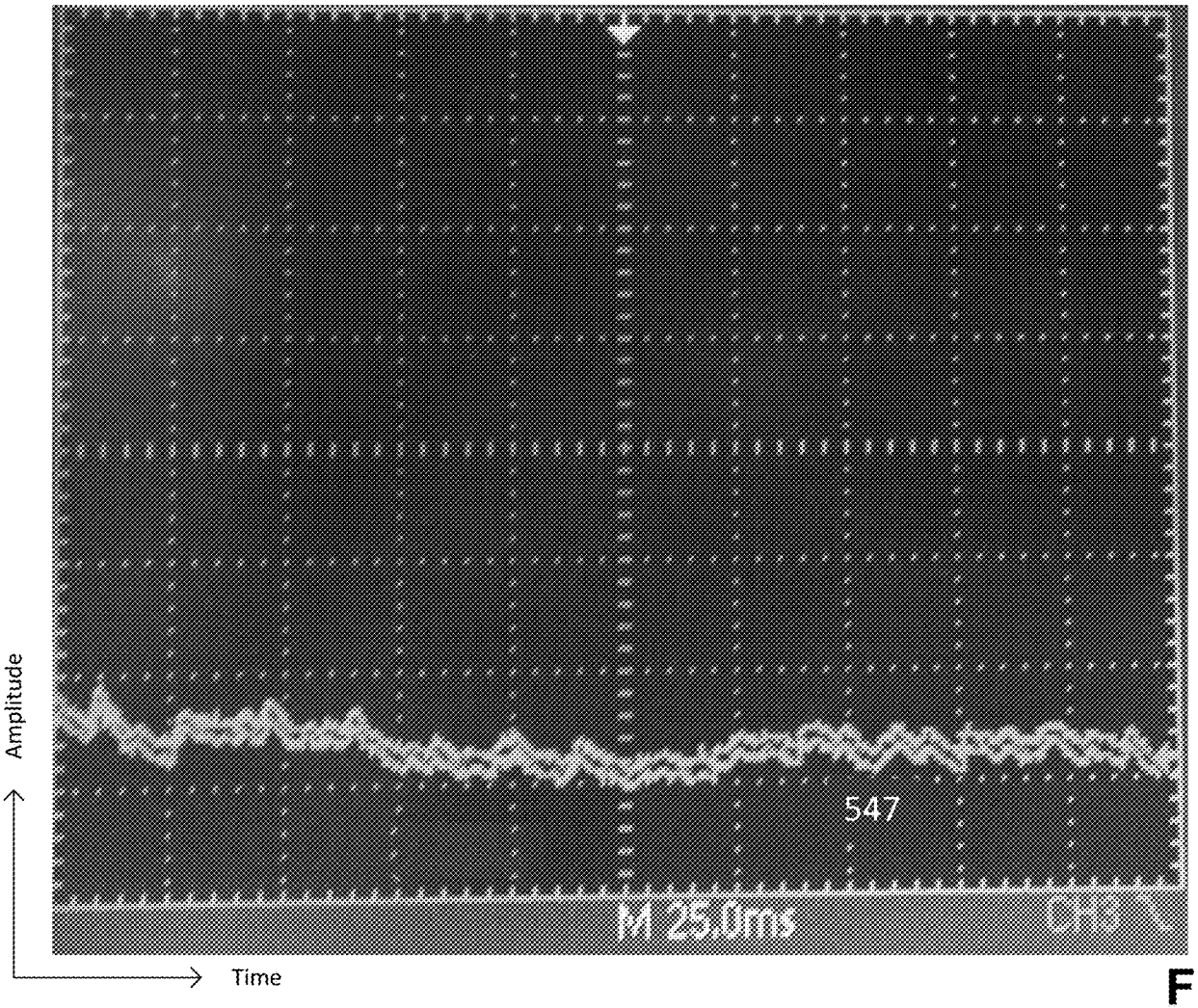
FIG. 5D illustrates an exemplary oscilloscope trace depicting an unchoked cymbal decay, according to some embodiments.
Figure 5E:
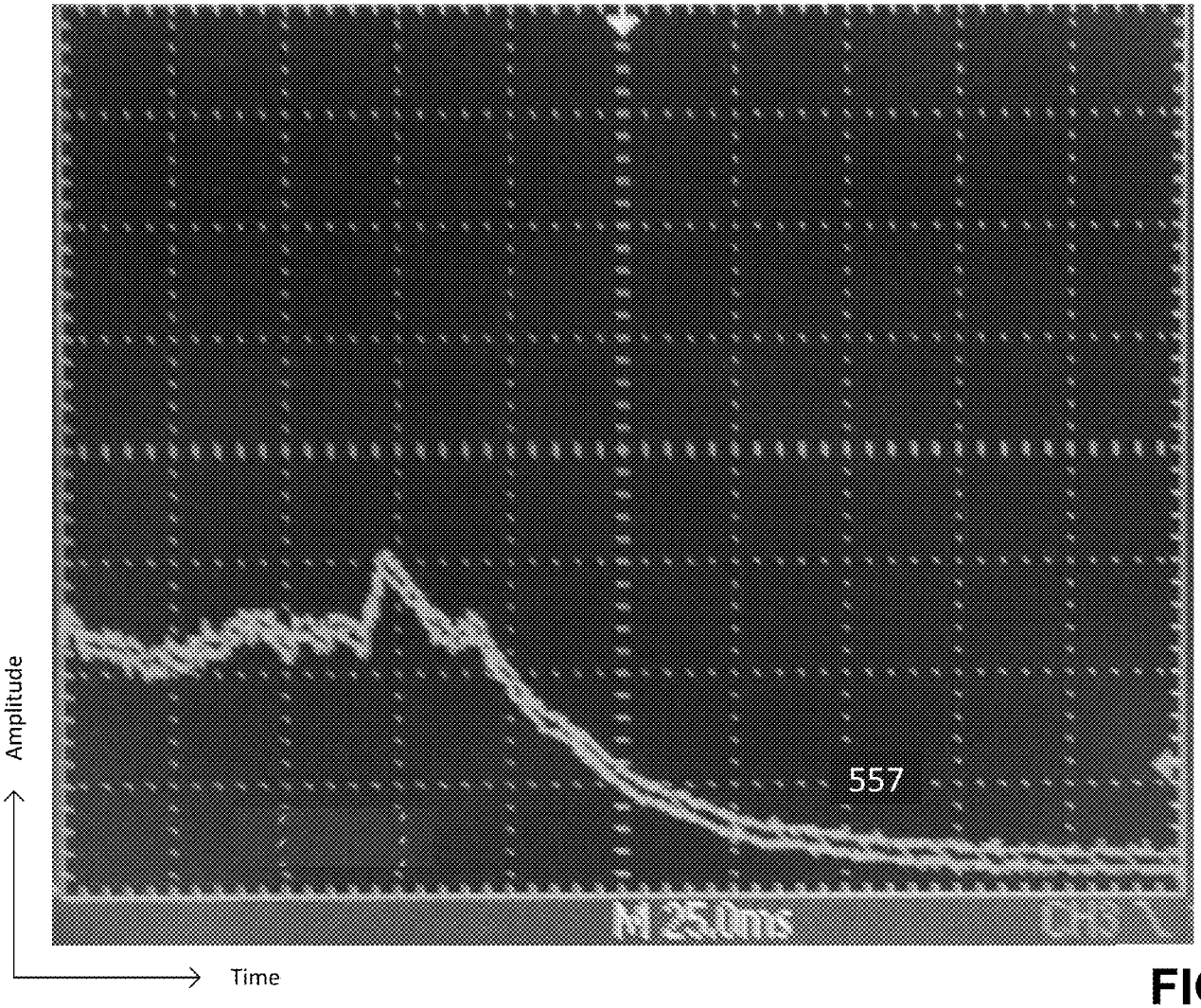
FIG. 5E illustrates an exemplary oscilloscope trace depicting a choked cymbal decay, according to some embodiments.

FIG. 5D illustrates an exemplary oscilloscope trace depicting an unchoked cymbal decay, according to some embodiments. Signal 547 indicates a level of choke input 452 shown in FIG. 4A (and/or a choke input 492 shown in FIG. 4B), some time after a cymbal has been struck. FIG. 5E illustrates an exemplary oscilloscope trace depicting a choked cymbal decay, according to some embodiments. Signal 557 indicates a level of choke input 452 shown in FIG. 4A (and/or a choke input 492 shown in FIG. 4B), some time after a cymbal has been struck. However, in contrast to FIG. 5D, the cymbal has recently been struck and then has been "choked" (e.g. by being grasped by a player). Consequently, the vibration of the cymbal has been damped by the choking, and the level of signal 557 decreases at a steeper slope than would be observed when the cymbal were allowed to decay naturally. Thus, this behavior may be used to identify a choke.

Figure 6A:
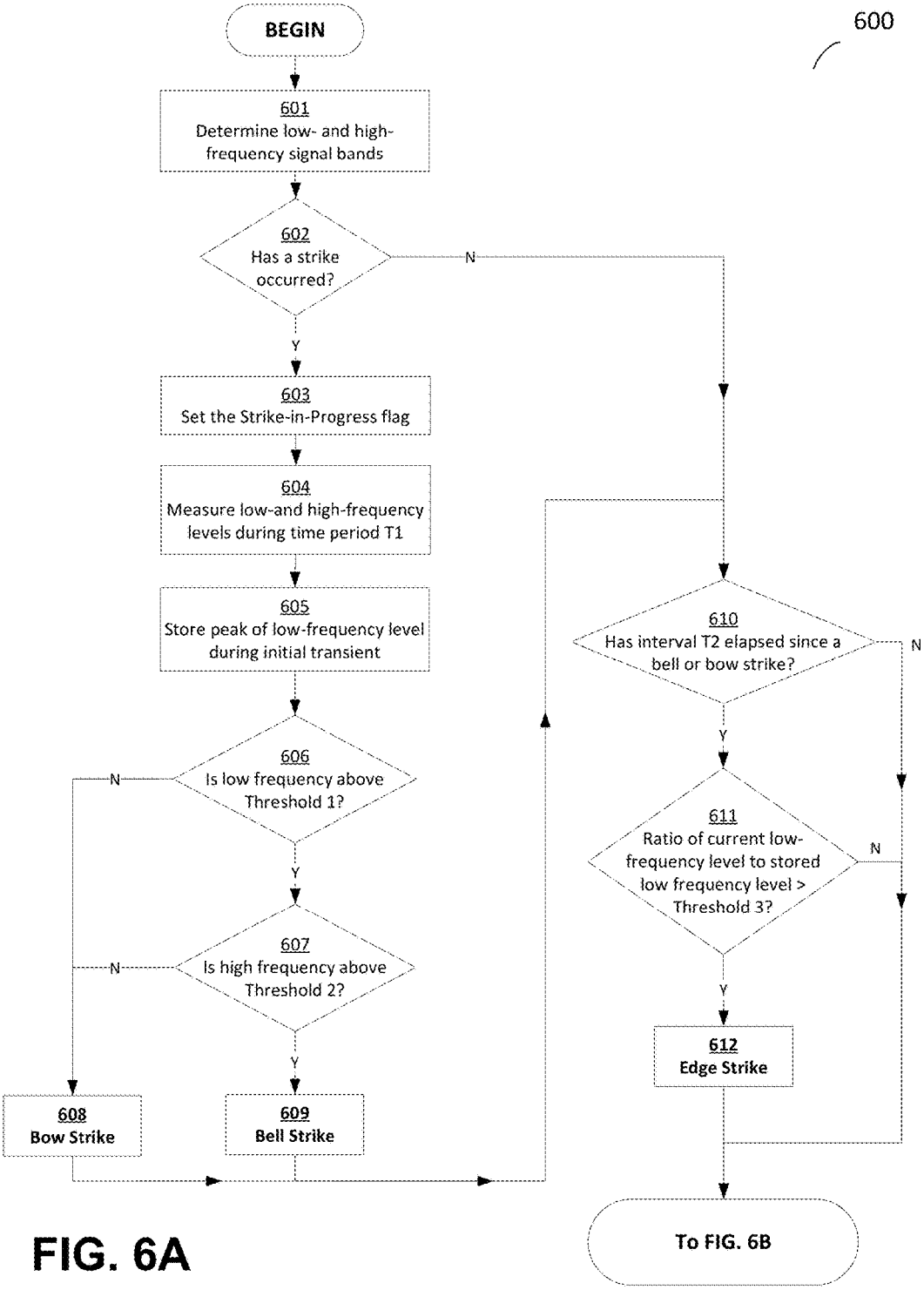
FIGS. 6A-B illustrate a flow chart depicting exemplary processing logic suitable for identifying a cymbal articulation, according to some embodiments.
Figure 6B:
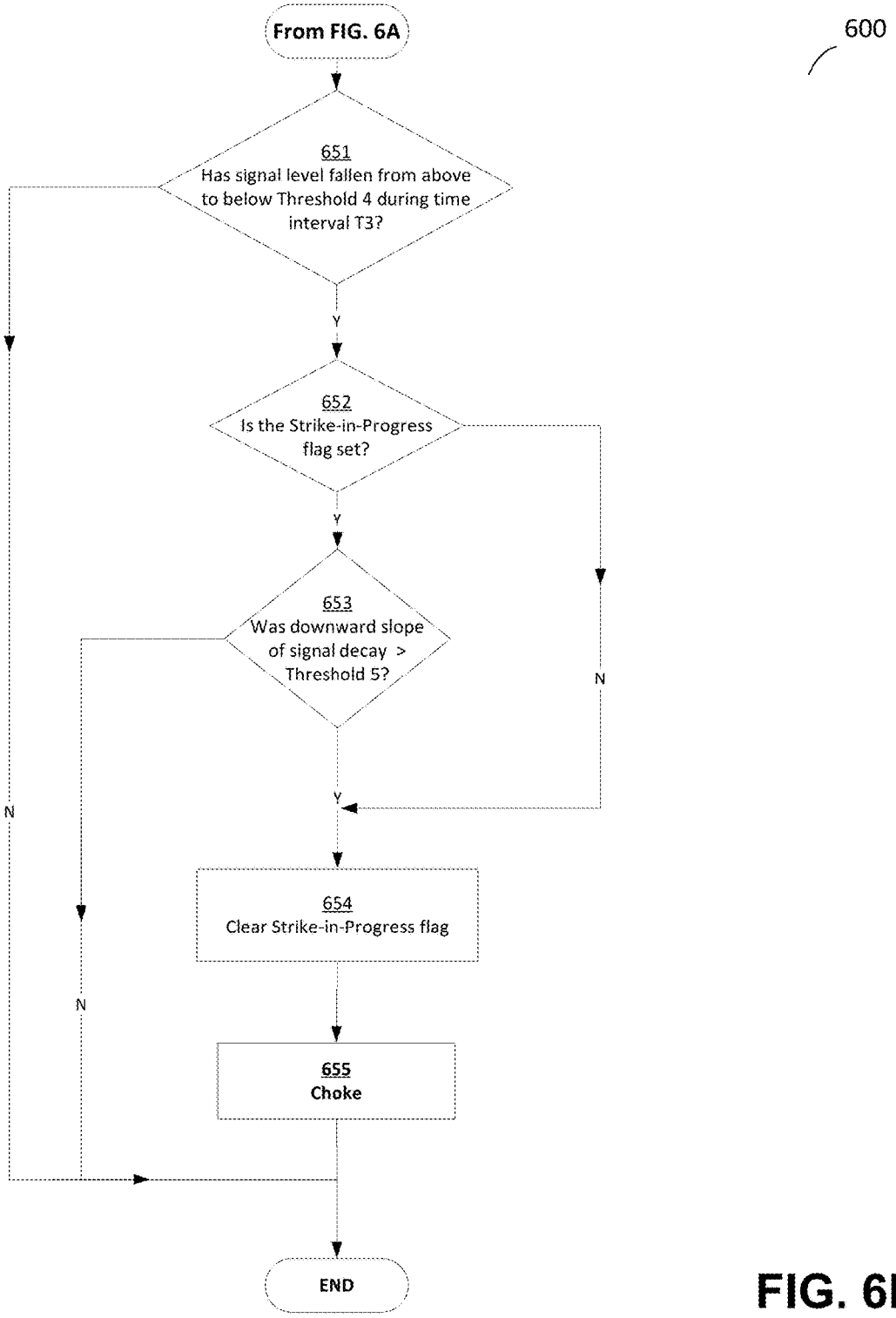

FIGS. 6A-B illustrate a flow chart depicting exemplary processing logic suitable for identifying a cymbal articulation, according to some embodiments. For example, FIGS. 6A-B may be used as processing logic in microcontroller 420 shown in FIG. 4A and/or as processing logic in microcontroller 470 show in FIG. 4B. However, method 600 shown in FIGS. 6A-B may generally be used in any suitable processing device that receives one or more input signals indicative of one or more strikes and/or a choke of a cymbal. FIGS. 6A-B illustrate a single sequence of steps, namely method 600, that have are presented as two separate figures to aid in clear illustration of the method.

Method 600 begins at step 601 in which high and low frequency bands of an input signal are determined. The input signal may include any signal generated by a transducer in response to a strike of a cymbal and/or to any other interaction between a player and the cymbal (e.g., a choke), including for example any one or more of signals 451, 452 or 453 shown in FIG. 4A and/or signals 491, 492 or 493 shown in FIG. 4B. The frequency bands of the input signal may be chosen, for example, so that particular types of cymbal strikes which resulted, at least in part, in the input signal may be identified using one or both of the frequency bands. For example, as discussed above, low frequency aspects of an input signal resulting from a strike of a cymbal may provide for identification of an edge strike. One non-limiting example of using the high and low frequency bands is described below relating to method 600.

In some embodiments, a low frequency band of an input signal is primarily, or entirely, composed of frequencies below a cutoff frequency that is between 300 Hz and 600 Hz. In some embodiments, a high frequency band of an input signal is primarily, or entirely, composed of frequencies above a cutoff frequency that is approximately 600 Hz. In some embodiments, frequencies of the low frequency and/or high frequency bands may depend at least in part on characteristics of a cymbal and/or a transducer used in the system performing method 600.

In step 602, method 600 determines whether a strike has occurred. Such a determination may be made in any suitable way. For example, it may be determined that a strike has occurred by recognizing that a level of an input signal has exceeded a threshold value, and/or by recognizing that a level of an input signal has changed by a value greater than a threshold within a particular time window. Irrespective of how it is determined that a strike has occurred, if a strike has occurred, method 600 proceeds to step 603, otherwise method 600 proceeds to step 610, described below.

In step 603, a Strike-in-Progress flag is set. This may be performed to store an indication that a strike has occurred so that a subsequent choke articulation can be subsequently identified. For example, if a choke strike were identified, the Strike-in-Progress flag's status (set or not set) may be used to determine whether to generate a choke trigger.

In step 604, the low and high frequency signal bands determined in step 601 are measured during a time period T1. The behavior of low and high frequency signals during a time window after a strike has been identified may be used to aid in identification of a strike articulation (that is, what type of strike occurred), and/or may be used to perform velocity scaling on any subsequent trigger signals that are output. In some embodiments, time period T1 lasts for between 1 ms and 2 ms, for example 1.5 ms.

In step 605, the peak value of the low frequency band signal determined in step 601 during the time window T1 is stored. The peak value may be stored on any suitable storage device(s) accessible to the system performing method 600, including any accessible volatile and/or non-volatile memory device(s).

In step 606, a low frequency level determined in step 601 during the time window T1 is compared with a first threshold. The low frequency level may be, for example, an average of the low frequency signal during T1, a peak level of the low frequency signal (e.g., as calculated in step 605), and/or any other suitable measurement of the low frequency aspects of an input signal. The first threshold may be chosen in any suitable way, for example, the first threshold may be chosen such that a low frequency level identified in step 606 below the first threshold may indicate, at least in part, that a bow strike has occurred.

If it is determined in step 606 that the low frequency level is equal to or below the first threshold, method 600 proceeds to step 608 in which a bow strike is identified. Alternatively, method 600 proceeds to step 607.

In step 607, a high frequency level determined in step 601 during the time window T1 is compared with a second threshold. The high frequency level may be, for example, an average of the high frequency signal during T1, a peak level of the high frequency signal (e.g., as calculated in step 605), and/or any other suitable measurement of the high frequency aspects of an input signal. The second threshold may be chosen in any suitable way, for example, the second threshold may be chosen such that a high frequency level identified in step 606 below the second threshold may indicate, at least in part, that a bow strike has occurred.

If it is determined in step 607 that the high frequency level is equal to or below the second threshold, method 600 proceeds to step 608 in which a bow strike is identified. Alternatively, method 600 proceeds to step 609 in which a bell strike is identified.

In the example of FIGS. 6A-B, steps 610 and 611 serve to identify whether an edge strike has occurred. As discussed above, an edge strike may in some use cases be indistinguishable from a bell or a bow strike for a time period after the strike. For example, it may be that while an edge strike is identifiable as generating more low-frequency energy overall than a bell or a bow strike, each type of strike may initially generate a lot of low-frequency energy, making it unclear as to the type of strike until low-frequency energy present in a bell or a bow strike would have died out. As further discussed above, a bell or bow strike trigger may be generated, and if it is subsequently determined that the strike was an edge strike, an edge trigger may be generated and provided to tone generator 304. If the time between the consecutive triggers is sufficiently short (e.g. less than approximately 50 ms), a user will not notice sound resulting from the first trigger; rather, to the user it will appear simply as if a tone corresponding to an edge trigger were generated.

Accordingly, in the example of FIGS. 6A-B, analysis of an edge strike is not performed until an interval has elapsed, which begins when either a bow strike is identified (which may give rise to a bow trigger signal) in step 608, or when a bell strike is identified (which may give to a bell trigger signal) in step 609. In step 610, it is determined whether this interval, which has a time length T2, has ended. If in step 610 it is determined that the interval has not yet passed, method 600 proceeds to step 651 (shown in FIG. 6B). If step 610 identifies that the time period T2 has elapsed, method 600 proceeds to step 611. The time interval T2 may be any suitable value, including between 5 ms and 60 ms, for example 30 ms.

In step 611, a ratio of: (i) a low frequency signal detected after the interval T2 has ended to (ii) the low frequency peak stored in step 605, is calculated and compared with a third threshold. The low frequency signal may include the same or different frequency components of the input signal than determined in step 601, such as frequencies below a cutoff frequency that is between 300-600 Hz. If it is determined in step 611 that the ratio is greater than the threshold, method 600 proceeds to step 612 in which an edge strike is identified. Otherwise, method 600 proceeds to step 651 (shown in FIG. 6B).

In the example of FIGS. 6A-B, steps 651-655 serve to identify whether a choke has occurred. As discussed above, a player of a cymbal can perform a "choke" by grabbing the cymbal by the hand to quickly dampen the sound. In some use cases a cymbal may no longer be substantially vibrating yet a player wishes to "play" a choke articulation. However, in such use cases the low amplitude of an input signal may inhibit detection of a choke. Accordingly, it may be beneficial to alternatively, or additionally, detect a choke by recognizing contact of a player with the cymbal, such as a "slap" of the cymbal by the player's fingertips. The example of FIGS. 6A-B includes both exemplary techniques for detecting a choke described above, namely the dampening of vibrations and the detection of a finger "slap" by a player.

In step 651, the change in a strike level during an interval T3 ending at the current time is determined, and compared with a fourth threshold. Since a choke may be characterized by a sharp drop in amplitude (e.g., due to a player grabbing the cymbal), in step 651 it is determined whether the amplitude fell from above a threshold that may be indicative of a strike (e.g., a bell, bow or edge strike) to below that threshold.

If the signal level analyzed in step 651 is determined not to have fallen from above the fourth threshold to below the fourth threshold in the interval T3, method 600 ends. Alternatively, method 600 proceeds to step 652, in which the Strike-in-Progress flag is examined. If the Strike-in-Progress flag is not set, yet nonetheless the signal level was determined not to have fallen from above the fourth threshold to below the fourth threshold in the interval T3, this may indicate that a player "slapped" the cymbal after the cymbal's vibrations had decayed to a relatively low amplitude. Accordingly, if the Strike-in-Progress flag is not set, method 600 proceeds to step 654.

Alternatively, if the Strike-in-Progress flag is determined to be set in step 652, the downward slope of a signal level is compared with a fifth threshold in step 653. The downward slope may be calculated over any suitable time period. As discussed above, a choke may be characterized as a sharp reduction in amplitude of a strike signal level. Accordingly, step 653 determines whether a signal level has fallen sufficiently quickly to identify a choke articulation. If the signal level has fallen quickly, thus producing a downward slope above the fifth threshold, this indicates a choke articulation and method 600 proceeds to step 654. Otherwise, if the signal level has fallen more slowly, thus producing a downward slope equal to or below the fifth threshold, no choke articulation is identified and method 600 ends.

In step 654, the Strike-in-Progress flag is cleared. In step 655, a choke articulation is identified.

Identification of cymbal articulations in steps 608, 609, 612 and/or 655 may, in some embodiments, cause one or more trigger signals corresponding to an identified cymbal articulation or articulations to be generated. For example, any of steps 608, 609, 612 and/or 655 may result in a bell, bow, edge and/or choke trigger signal to be generated, and in some use cases, provided to a device coupled to the device performing method 600.

In some embodiments, values of the first, second, third, fourth and/or fifth thresholds described above may depend on characteristics of a cymbal used in conjunction with method 600, and/or on characteristics of a transducer used in conjunction with method 600.

Method 600 shown in FIGS. 6A-B is provided as one example of identifying a cymbal articulation based on a signal received from a transducer which has detected an acoustic signal in response to a cymbal strike. As discussed above, however, in general any such algorithm or process may be utilized.

FIGS. 7A-7M are flowcharts depicting exemplary logic that may be used to determine, based on the output of a transducer coupled to a cymbal, a manner in which the cymbal was struck based on a signal output by the transducer resulting from said strike. It will be appreciated that the following flowcharts are provided as exemplary processing steps and that any suitable techniques, including any analog and/or digital electronic components, may be used to determine a manner in which a cymbal was struck.

The methods illustrated in FIGS. 7A-7M may be performed, for example, by processing circuitry 303 shown in FIG. 3 and includes processing logic that receives one or more inputs from a suitable transducer coupled to a cymbal, such as transducer 302 shown in FIG. 3, and provides trigger signals to a suitable tone generator, such as tone generator 304 shown in FIG. 3.

The methods illustrated in FIGS. 7A-7M may alternatively, or additionally, be performed by microcontroller 420 shown in the examples of FIG. 4A and/or FIG. 4B. Accordingly, inputs to the microcontroller, namely the strike level 451, the choke level 452 and the edge level 453 (or corresponding inputs 491-493 shown in FIG. 4B), may be used as inputs to the illustrated methods. Other quantities may also be used as inputs, any of which may be stored in any suitable location and/or provided by a transducer along with a signal representing a cymbal strike.

The exemplary logic shown in FIGS. 7A-7M may be employed in any suitable electronic cymbal described herein, not necessarily having the characteristics of system 300 nor system 400 or system 450, and/or may utilize any number and any type of inputs compatible with the logic described below, and may output any number and any type of trigger signals to a device compatible with the logic described below.

Figure 7A:
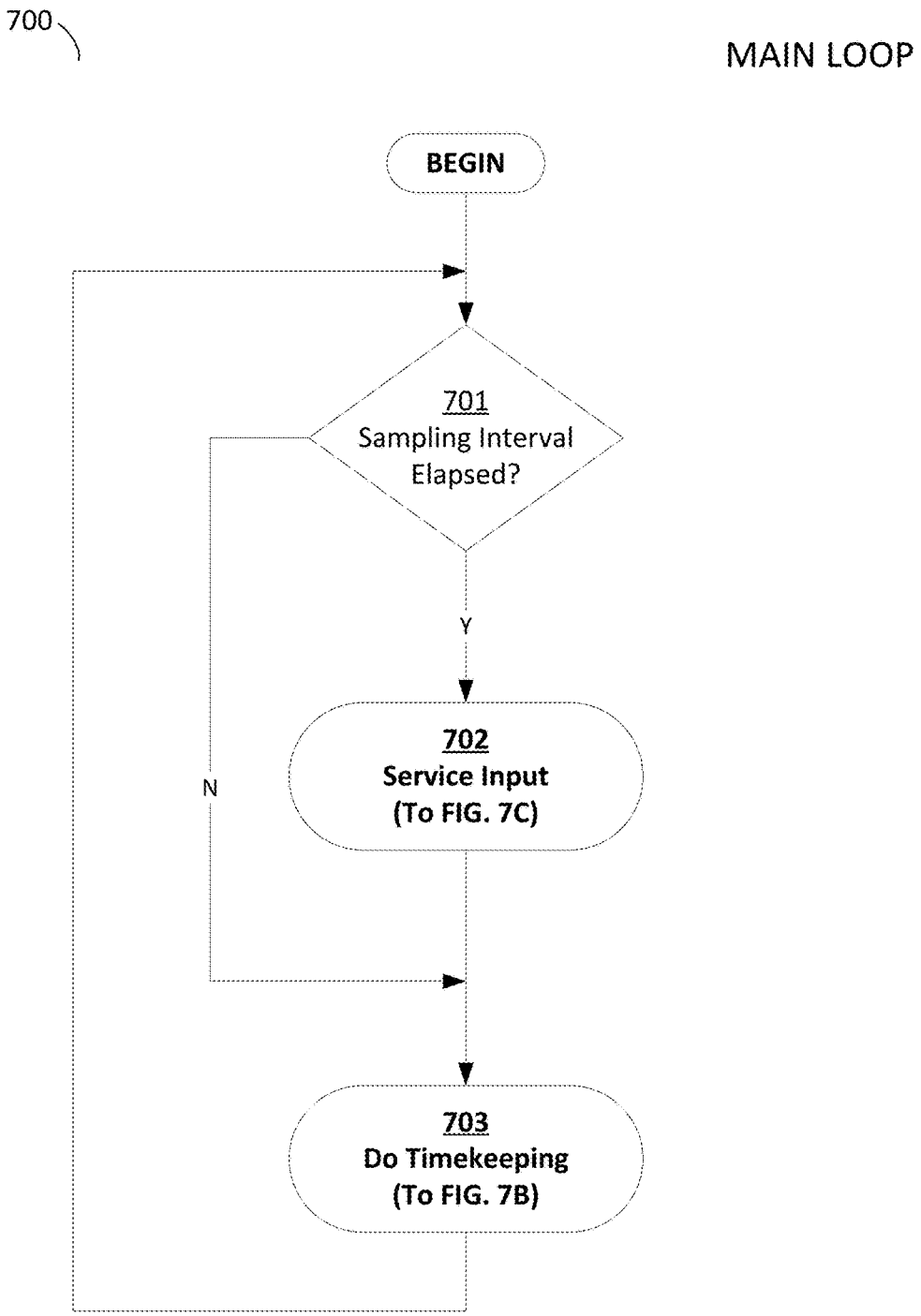
FIG. 7A illustrates a flow chart depicting a main loop of processing logic suitable for identifying a cymbal articulation, according to some embodiments.

FIG. 7A illustrates a flow chart depicting a main loop of processing logic suitable for identifying a cymbal articulation, according to some embodiments. Method 700 represents a loop in which examination of one or more inputs may be periodically performed in order to ascertain whether a cymbal, to which the device performing method 700 is coupled, has been struck.

Method 700 begins in step 701 in which it is determined whether inputs should be examined to determine whether a cymbal articulation has occurred. This determination may be made in any suitable way, including by use of a timer. In the example of FIG. 7A, the determination is made by counting a number of samples on a digital input, and by examining one or more inputs every time a number of samples has been counted. For example, a digital input may have a frequency of 20 kHz, and the sampling interval used in step 701 may be twenty samples. In this example, step 702 will be performed once every millisecond (i.e. the duration of twenty 50 μs samples). However, in general, any suitable sampling frequency and any suitable sampling interval that is a multiple of the length of the sample, may be used.

When it is determined in step 701 that the sampling interval has elapsed, step 702 is performed, in which one or more inputs are examined to determine whether a cymbal strike has occurred, and if so, to determine a cymbal articulation corresponding to the strike. Upon completion of step 702, method 700 proceeds to step 703. An exemplary processing logic for step 702 is discussed below in relation to FIG. 7C. When it is determined in step 701 that the sampling interval has not yet elapsed, method 700 proceeds to act 703.

In step 703, timekeeping acts are performed. Timekeeping acts may include any acts that are performed periodically that do not include detection of a cymbal strike. Timekeeping acts may include detection of a choke, since a choke may occur independently of a cymbal strike. Moreover, timekeeping acts may comprise setting and/or examining timers relating to masking and/or triggers generated for a length of time. An exemplary processing logic for step 703 is discussed below in relation to FIG. 7B. Once step 703 has been completed, method 700 returns to step 701, and may accordingly continue as described above, which may be indefinitely.

Figure 7B:
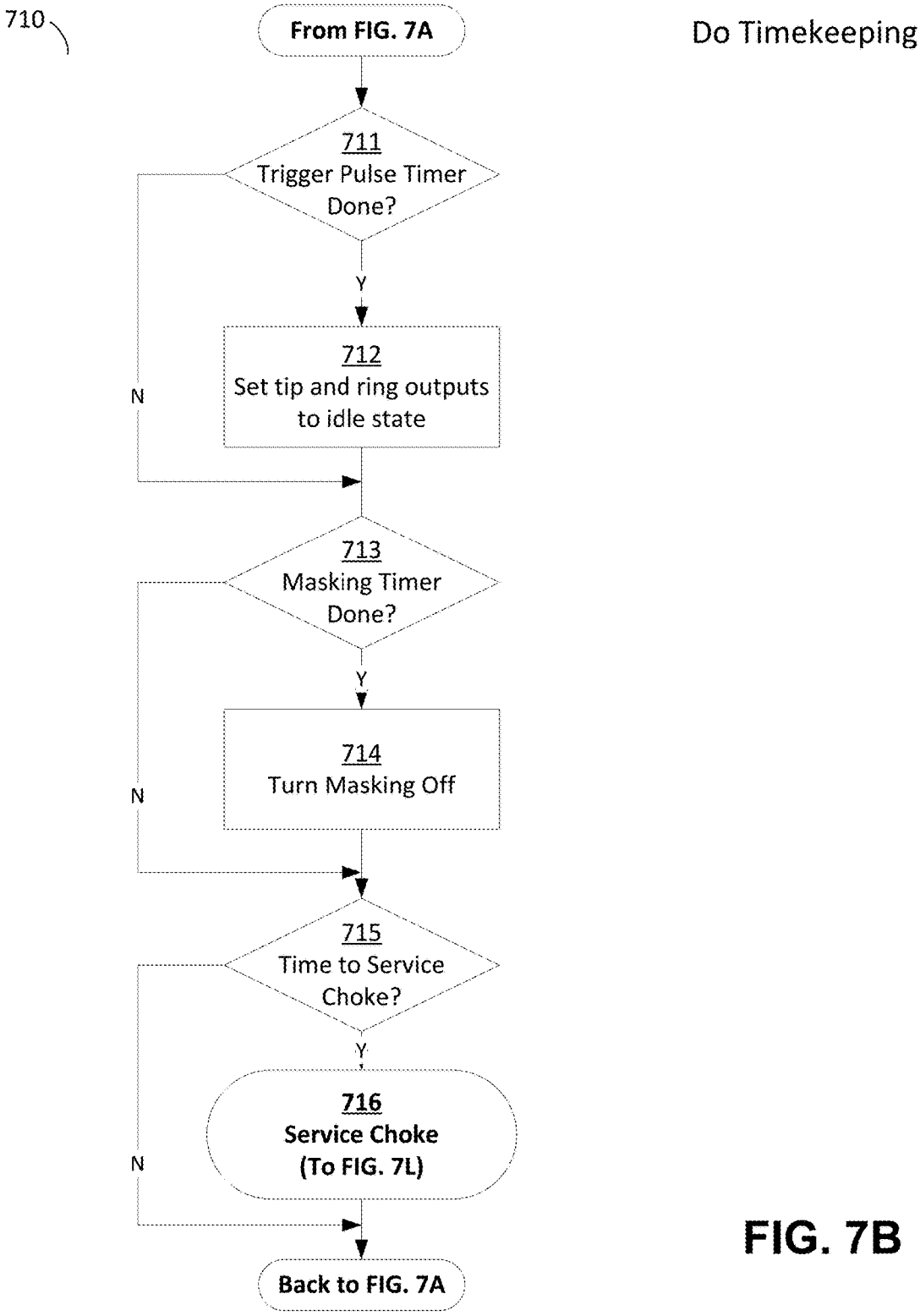
FIG. 7B illustrates a flow chart depicting a timekeeping step of exemplary processing logic suitable for identifying a cymbal articulation, according to some embodiments.

FIG. 7B illustrates a flow chart depicting a timekeeping step of exemplary processing logic suitable for identifying a cymbal articulation, according to some embodiments. Method 710 illustrates a sequence of timekeeping actions that may be performed periodically, for example as step 703 shown in FIG. 7A. In step 711, the state of a trigger pulse timer is examined. A trigger pulse timer may be set when a trigger pulse is output by a system performing the exemplary logic shown in FIGS. 7A-7M, for example when a cymbal strike indicating a sound lasting for a period of time is detected, and a trigger pulse is generated for a corresponding period of time. Step 711 may ascertain whether the duration of a trigger pulse currently being output has been met, and if so may instruct the system to cease outputting the trigger pulse in step 712.

In step 713, a masking timer is examined. As discussed above, a masking timer may allow an electronic cymbal to ignore new detections of a cymbal strike for a period after a previous strike has been detected. In step 713, a masking timer is examined to determine whether a previously set masking timer has ended. If so, in step 714, a flag indicating that masking is currently being employed is turned off. If a masking timer has not been set, or if a masking timer has been set but is not yet due to end, method 710 proceeds to step 715.

In step 715, it is determined whether detection of a choke should be performed. Such a determination may be made based on whether a time period has elapsed since the last such detection. For example, since a choke occurs over a period of time, it may be desirable (e.g., more efficient) to perform detection of a choke during a subset of the times that timekeeping method 710 is performed. This may be performed in any suitable way, such as by setting a timer that is examined in step 715, and/or by counting a sampling interval of a digital input.

Irrespective of how step 715 makes its determination, either detection of a choke is performed in step 716, or method 710 returns to step 703 in FIG. 7A, step 703 now being completed. An exemplary processing logic for step 716 is discussed below in relation to FIG. 7L.

Figure 7C:
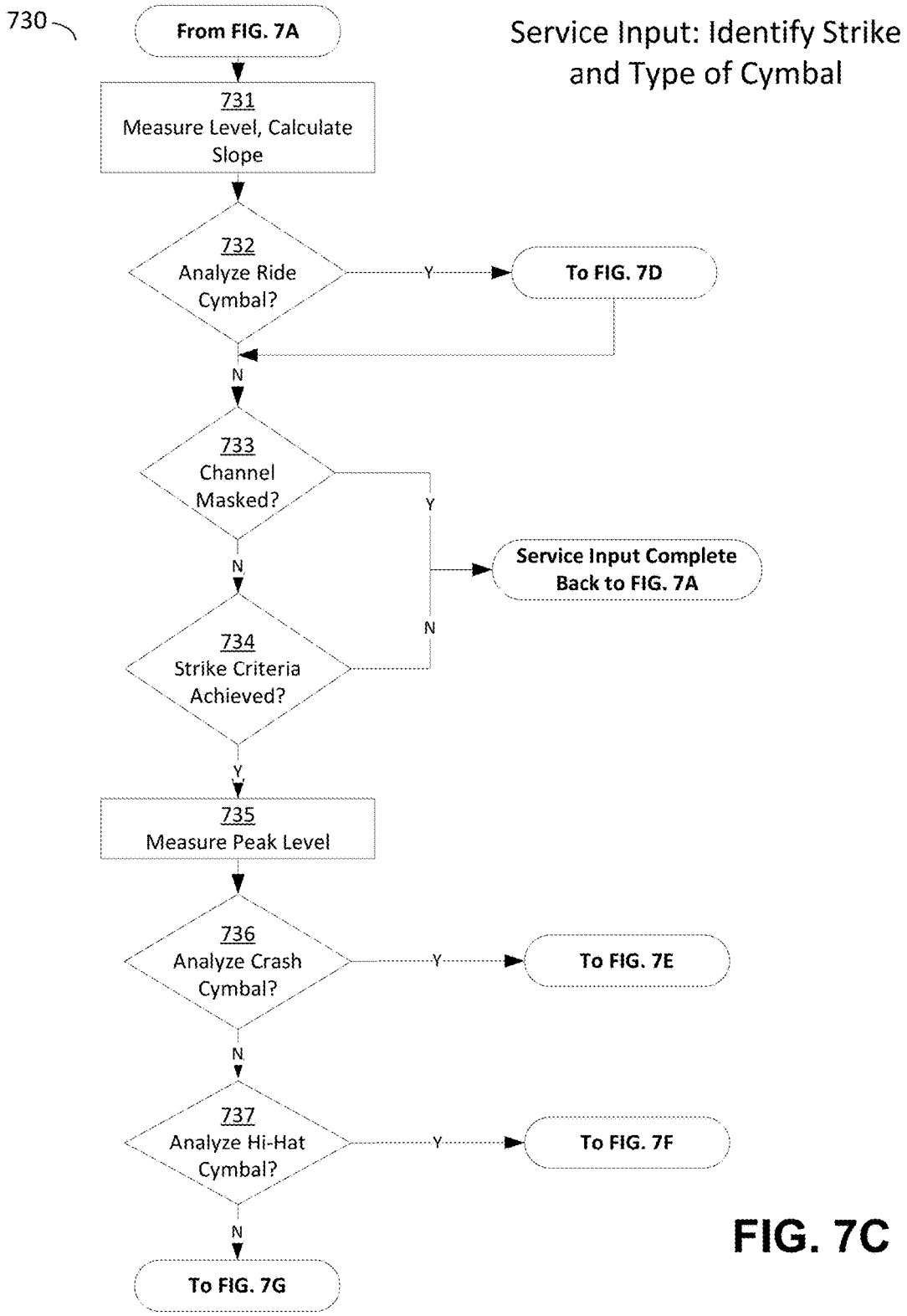
FIG. 7C illustrates a flow chart depicting a service input step of exemplary processing logic suitable for identifying a cymbal articulation, according to some embodiments.

FIG. 7C illustrates a flow chart depicting a service input step of exemplary processing logic suitable for identifying a cymbal articulation, according to some embodiments. Method 730 illustrates a sequence of actions that may be performed to identify whether a strike of a cymbal has occurred, and in addition if it is determined that a strike has occurred, to identify a cymbal articulation corresponding to the strike.

Method 730 begins with step 731 in which the level and slope of an input to the system employing the exemplary logic shown in FIG. 7C is measured. The input may comprise any indication of an amplitude of an acoustic signal detected by a transducer in response to a cymbal coupled to the transducer being struck. For example, where method 730 is employed in the system of FIG. 4A and/or the system of FIG. 4B, the input may correspond to the strike level 451 or the strike level 491, respectively.

Irrespective of how an amplitude of an acoustic signal detected by a transducer is provided to the system performing method 730, step 731 may additionally calculate the slope of the input level. The slope, being the rate of change of the input level, may be calculated over any time period (or time periods) so as to obtain one or more indications of the rate of change of the input level. In addition, an indicator that a strike is in progress may be set in step 731, which may allow subsequent steps to perform processing based on whether a strike has been identified as having occurred or not.

In step 732, it is determined whether a ride cymbal analysis will be performed. This may be determined, for example, by examining one or more flag values available to the electronic cymbal and/or to the system coupled to the electronic cymbal performing method 730. For example, one or more components may include a switch indicating a type of cymbal, and method 730 may utilize a setting of this switch to determine the logical steps that are performed in determining a type of cymbal articulation that has occurred.

In the example of FIG. 7C, if it is determined that a ride cymbal analysis is to be performed, method 730 proceeds to method 740 shown in FIG. 7 D. Otherwise, method 730 proceeds to step 733.

In step 733, it is determined whether a channel corresponding to a trigger output signal is masked. As discussed above, a suitable processing circuitry may include one or more channels corresponding to cymbals to which the processing circuitry is coupled. In step 733, a channel may be examined to determine whether it is masked. If the channel is masked, any subsequently detected cymbal strikes will be ignored, and accordingly method 730 ends by returning to step 702 shown in FIG. 7A. Otherwise, if the channel is not masked, method 730 proceeds to step 734.

In step 734 it is determined whether criteria that indicate a strike of a cymbal has occurred have been met. Such criteria may depend, at least in part, on the level and/or slope calculated in step 731, and/or may depend other values accessible to the system, such as threshold values. If the strike criteria are not achieved, method 730 ends by returning to step 702 shown in FIG. 7A. Otherwise, if a strike is detected, method 730 proceeds to step 735.

In step 735, the peak level of the input is determined. Since the level of the input sufficient to denote a strike may be lower than the peak level of the input, it may be necessary to wait for the input to reach its peak level in order to determine what the peak level is. In step 735, the peak level may be measured in any suitable way, including but not limited to, waiting for a particular length of time (which may depend on the type of cymbal being used) and measuring a maximum level during that time, and/or measuring the amplitude and/or the slope of the input level one or more times to determine when a peak has been reached. In some embodiments, the peak level is measured by waiting for between 400 μs and 800 μs while measuring the input level, and then identifying the peak level in that time period.

In step 736, it is determined whether a crash cymbal analysis will be performed. This may be determined by examining one or more flag values available to the electronic cymbal and/or to the system coupled to the electronic cymbal performing method 730. For example, one or more components of the system may include a switch indicating the type of cymbal to which it is coupled, and method 730 may utilize the setting of such a switch to determine steps that are performed in determining a type of cymbal articulation that has occurred.

Figure 7D:
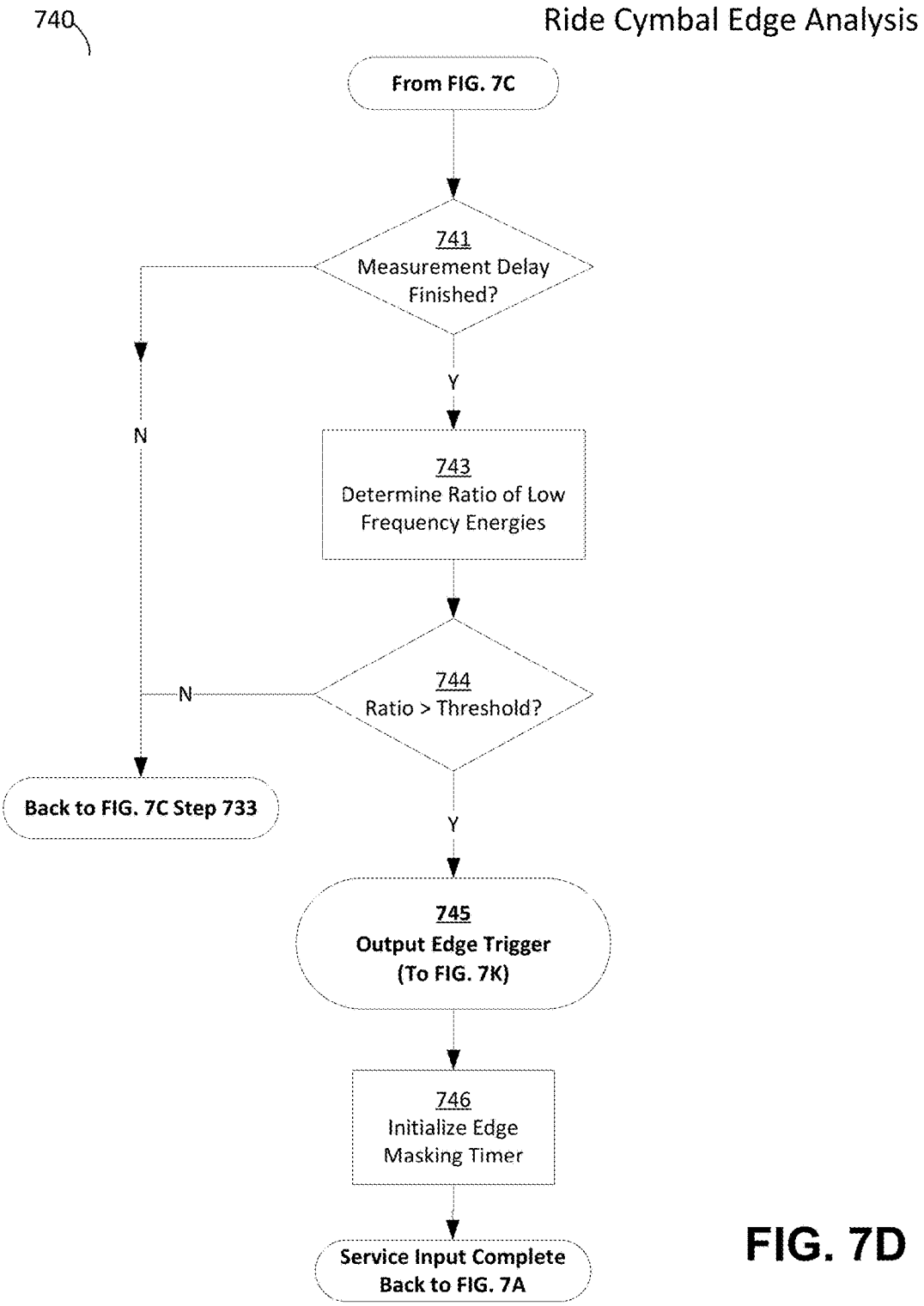
FIG. 7D illustrates a flow chart depicting a ride cymbal edge analysis step of exemplary processing logic suitable for identifying a cymbal articulation, according to some embodiments.
Figure 7E:
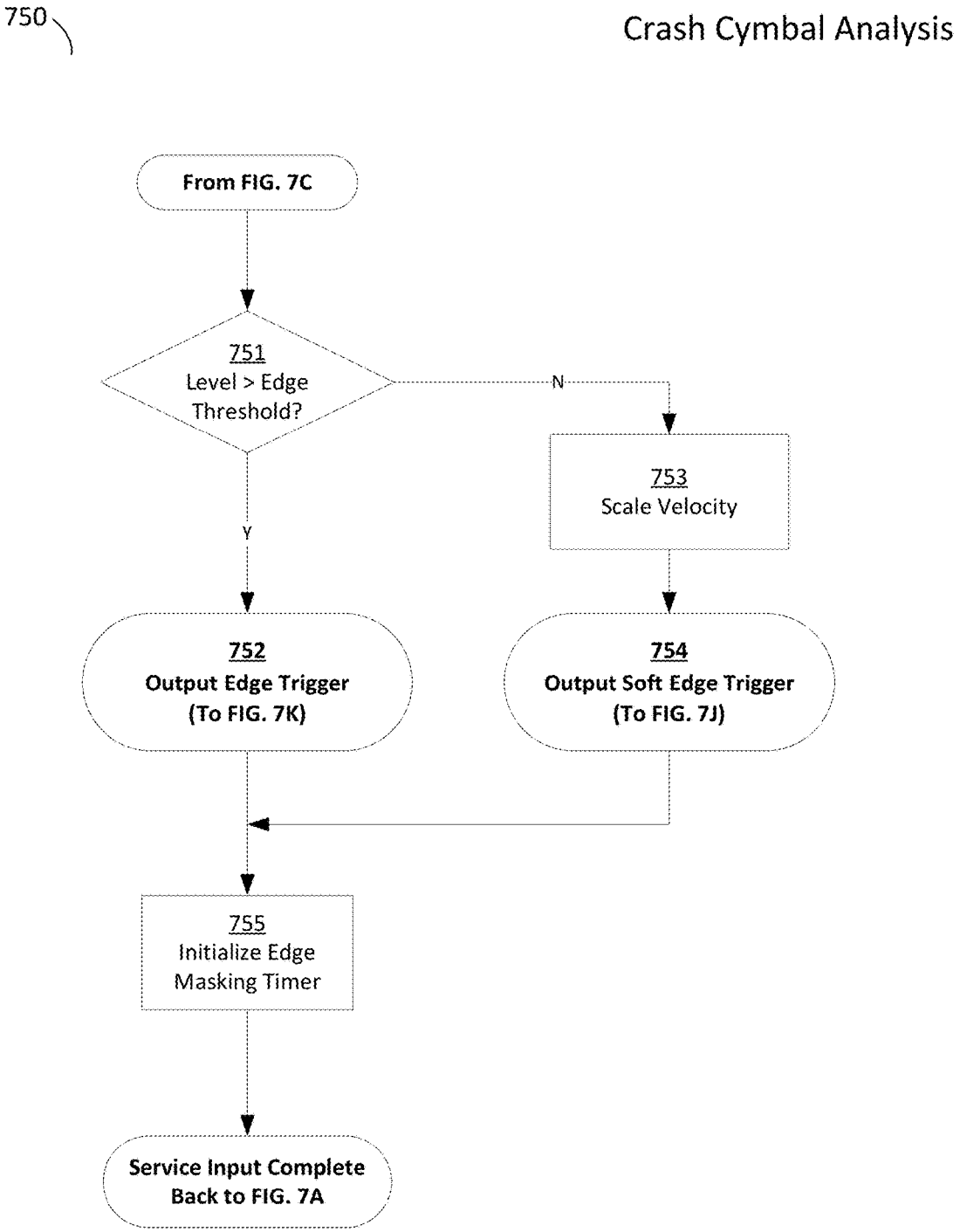
FIG. 7E illustrates a flow chart depicting a crash cymbal analysis step of exemplary processing logic suitable for identifying a cymbal articulation, according to some embodiments.

In the example of FIG. 7C, if it is determined that a crash cymbal analysis is to be performed, method 730 proceeds to method 750 shown in FIG. 7E. Otherwise, method 730 proceeds to step 737.

In step 737, it is determined whether a hi-hat cymbal analysis will be performed. This may be determined by examining one or more flag values available to the electronic cymbal and/or to the system coupled to the electronic cymbal performing method 730. For example, one or more components of the system may include a switch indicating the type of cymbal to which it is coupled, and method 730 may utilize the setting of this switch to determine steps that are performed in determining a type of cymbal articulation that has occurred.

Figure 7F:
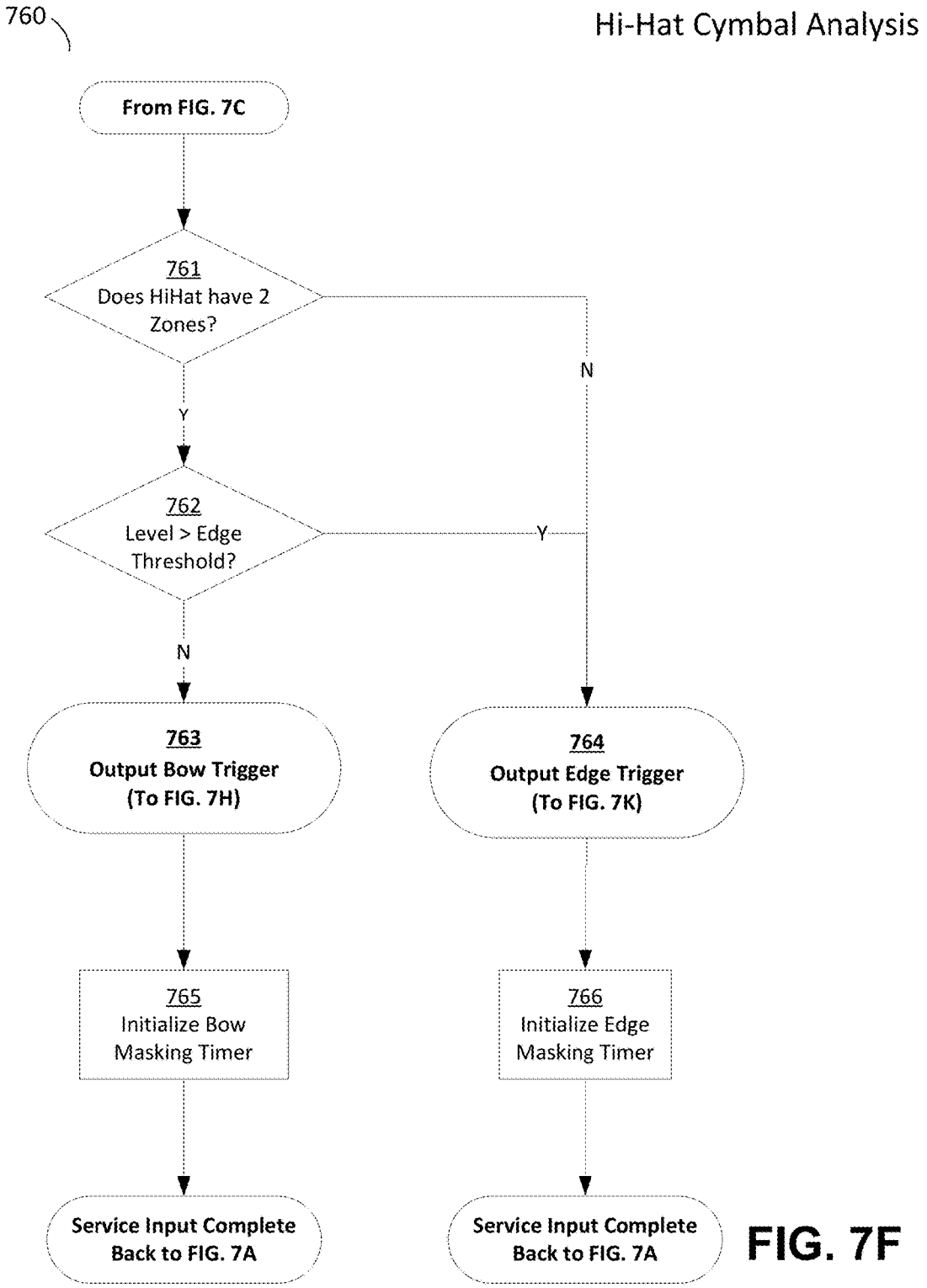
FIG. 7F illustrates a flow chart depicting a hi-hat cymbal analysis step of exemplary processing logic suitable for identifying a cymbal articulation, according to some embodiments.

In the example of FIG. 7C, if it is determined that a hi-hat cymbal analysis is to be performed, method 730 proceeds to method 760 shown in FIG. 7F. Otherwise, method 730 proceeds to method 770 shown in FIG. 7G in which a ride cymbal analysis is performed.

FIG. 7D illustrates a flow chart depicting a ride cymbal edge analysis step of exemplary processing logic suitable for identifying a cymbal articulation, according to some embodiments. Method 740 illustrates a sequence of actions that may be performed to identify whether an edge strike of a ride cymbal has occurred. Method 740 begins with step 741.

As discussed above, an edge strike may in some use cases be indistinguishable from a bell or a bow strike for a time period after the strike. For example, it may be that while an edge strike is identifiable as generating more low-frequency energy overall than a bell or a bow strike, each type of strike may initially generate a lot of low-frequency energy, making it unclear as to the type of strike until low-frequency energy present in a bell or a bow strike would have died out.

Accordingly, in the example of FIG. 7D, analysis of an edge strike is not performed until a measurement delay period, which is initiated when a trigger is generated, has ended. In step 741, it is determined whether this delay period has ended. If in step 741 it is determined that the delay period has not ended, method 740 returns to step 733 in FIG. 7C. Thus, the remaining steps in FIG. 7C will result in a trigger being generated when the strike criteria has been achieved, but subsequently the measurement delay will complete and the method of 740 will proceed to step 743. Hence, when a strike of a ride cymbal is generated, a bell or a bow trigger is generated but after a measurement delay the steps of method 740 beginning with step 743 are performed in order to determine whether the strike of the ride cymbal was an edge strike. The measurement delay may be any suitable value, including between 5 ms and 60 ms, for example 30 ms.

In step 743, a ratio of low frequency components of the current edge input to low frequency components in the edge input during an initial strike analysis period (e.g., during step 731), is determined. For example, the low frequency components of the edge input may comprise the edge input itself, or may comprise aspects of the signal, such as those aspects having a frequency lower than the highest frequency present in the edge input. As discussed above, an edge strike may be identified based on an amplitude of low-frequency aspects of an acoustic signal, and accordingly determining the extent to which said low-frequency aspects at the present time differ from those detected at an earlier time may aid in identification of an edge strike.

In step 744, the ratio determined in step 743 is examined to determine whether it is greater than a threshold associated with an edge strike. The edge threshold may be chosen such that a ratio exceeding the edge threshold will indicate that an edge strike has occurred. If the peak edge level does not exceed the edge threshold, method 740 proceeds back to step 733 shown in FIG. 7C. Otherwise, method 740 proceeds to step 745.

In step 745, an edge trigger is generated by the system. Exemplary steps for outputting an edge trigger are illustrated in FIG. 7K. In step 746, a masking timer associated with an edge trigger is initialized. The masking timer may have a value that corresponds to a length of time after generation of an edge trigger in which subsequent cymbal strikes are ignored. In some embodiments, an edge masking timer lasts for approximately 50 ms. Method 740 ends by returning to step 702 shown in FIG. 7A.

FIG. 7E illustrates a flow chart depicting a crash cymbal analysis step of exemplary processing logic suitable for identifying a cymbal articulation, according to some embodiments. Method 750 illustrates a sequence of actions that may be performed to identify whether an edge or soft edge strike of a crash cymbal has occurred. In step 751, the peak level determined in step 735 shown in FIG. 7C is examined to determine whether it is greater than a threshold associated with an edge strike.

The edge threshold value used in step 751 may be chosen to distinguish between hard and soft edge strikes on a crash cymbal. Crash cymbals tend to provide a loud, sharp sound, and as such a strike of a crash cymbal amounts to an edge strike the vast majority of the time. In the example of FIGS. 7A-7M, a crash cymbal is analyzed as if it always produces an edge strike, though distinguishes between harder strikes of the crash cymbal and softer strikes of the crash cymbal by comparing the amplitude of the strike to the edge threshold in step 751.

If it is determined in step 751 that the peak level exceeds the edge threshold, method 750 proceeds to step 752 in which an edge trigger is generated by the system. Exemplary steps for outputting an edge trigger are illustrated in FIG. 7K. Otherwise, if it is determined in step 751 that the peak level does not exceed the edge threshold, method 750 proceeds to step 753 in which a velocity value corresponding to the soft edge trigger to be generated is scaled based on the peak level and/or the edge threshold. Accordingly, a soft edge trigger output in step 754 may be afforded the full dynamic range available to a tone generator receiving the trigger signal. Exemplary steps for outputting a soft edge trigger are illustrated in FIG. 7J.

Irrespective of which type of trigger is output in step 752 or 754, in step 755 a masking timer associated with an edge trigger is initialized. The masking timer may have a value that corresponds to a length of time after generation of an edge trigger in which subsequent cymbal strikes are ignored. In some embodiments, the edge masking timer lasts for approximately 50 ms. Method 750 ends by returning to step 702 shown in FIG. 7A.

FIG. 7F illustrates a flow chart depicting a hi-hat cymbal analysis step of exemplary processing logic suitable for identifying a cymbal articulation, according to some embodiments. Method 760 illustrates a sequence of actions that may be performed to identify whether a bow or edge strike of a hi-hat cymbal has occurred.

Method 760 begins with step 761 in which it is determined whether the hi-hat cymbal has two zones. A setting as to the number of zones of the hi-hat cymbal may be stored or accessed by the system in any suitable way. In some embodiments, whether the hi-hat cymbal has two zones may be specified as a user preference. In the example of FIG. 7F, when a hi-hat does not have two zones, it is treated as always generating an edge trigger. Alternatively, in the example of FIG. 7F when a hi-hat does have two zones, it may generate a bow trigger or an edge trigger depending on whether the peak input level exceeds an edge threshold or not.

Step 762 determines, in the case of hi-hats with two zones, whether the peak input level exceeds the edge threshold. If it does, method 760 outputs an edge trigger in step 764. Otherwise, a bow trigger is output in step 763.

Subsequent to the output of an edge trigger or a bow trigger in method 760, a masking timer is initialized in step 766 or 765, respectively. As discussed above, the length of a masking timer may depend upon the type of strike identified. In some embodiments, an edge masking timer lasts for approximately 50 ms. In some embodiments a bow masking timer lasts for approximately 35 ms. Irrespective of which type of trigger is output in method 760, method 760 ends by returning to step 702 shown in FIG. 7A.

Figure 7G:
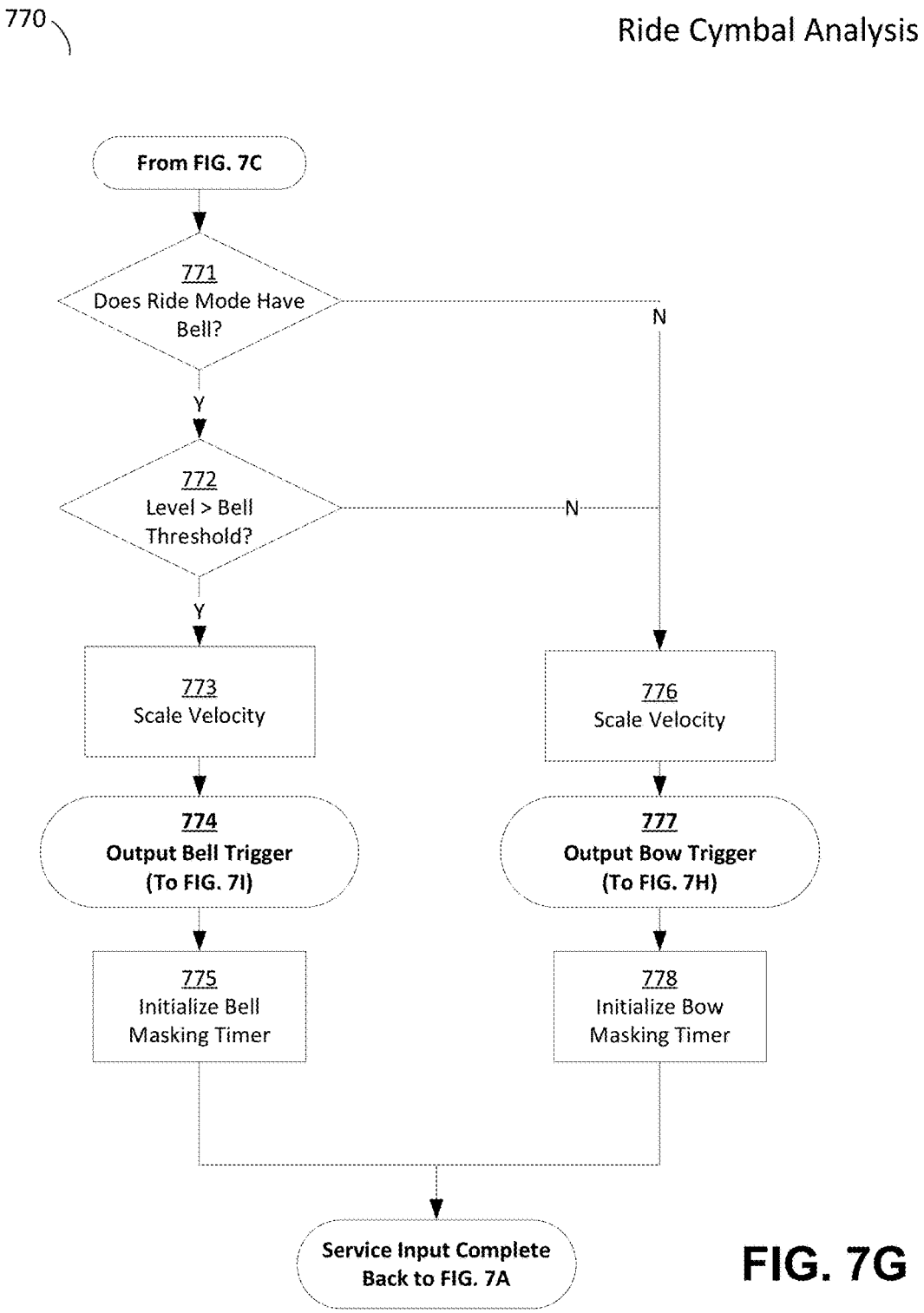
FIG. 7G illustrates a flow chart depicting a ride cymbal analysis step of exemplary processing logic suitable for identifying a cymbal articulation, according to some embodiments.

FIG. 7G illustrates a flow chart depicting a ride cymbal analysis step of exemplary processing logic suitable for identifying a cymbal articulation, according to some embodiments. Method 770 illustrates a sequence of actions that may be performed to identify whether a bell or bow strike of a ride cymbal has occurred.

Method 770 begins with step 771 in which it is determined whether the ride cymbal analysis includes analysis of a bell strike. A setting as to whether the ride cymbal includes analysis of a bell strike may be stored or accessed by the system in any suitable way. In some embodiments, such a setting may be specified as a user preference. In the example of FIG. 7G, when the ride cymbal analysis does not include analysis of a bell strike, a strike of the ride cymbal is treated as always generating a bow trigger. Alternatively, in the example of FIG. 7G when the ride cymbal analysis does include analysis of a bell strike, a bell trigger or an bow trigger may be generated depending on whether the peak input level exceeds a bell threshold or not.

Step 772 determines, in the case of a ride cymbal analysis including analysis of a bell strike, whether the peak input level exceeds a bell threshold. If it does, method 770 proceeds to step 773. Otherwise, method 770 proceeds to step 776.

In step 773, a velocity value corresponding to a bell trigger to be generated may be scaled. For example, such scaling may be based, at least in part, on the peak level and/or the bell threshold used in step 772. A bell trigger is output in step 773, which may have been scaled in step 772. Exemplary steps for outputting a bell trigger are illustrated in FIG. 7I.

Subsequent to the output of a bell trigger in step 774, a masking timer is initialized in step 775. As discussed above, the length of a masking timer may depend upon the type of strike identified. In some embodiments, a bell masking timer lasts for approximately 120 ms.

In step 776, velocity value corresponding to a bow trigger to be generated may be scaled. For example, such scaling may be based, at least in part, on the peak level. A bow trigger is output in step 777, which may have been scaled in step 776. Exemplary steps for outputting a bow trigger are illustrated in FIG. 7H.

Subsequent to the output of the bow trigger in step 777, a masking timer is initialized in step 778. As discussed above, the length of a masking timer may depend upon the type of strike identified. In some embodiments, a bow masking timer lasts for approximately 35 ms.

Irrespective of which type of trigger is output in method 770, method 770 ends by returning to step 702 shown in FIG. 7A.

Figure 7H:
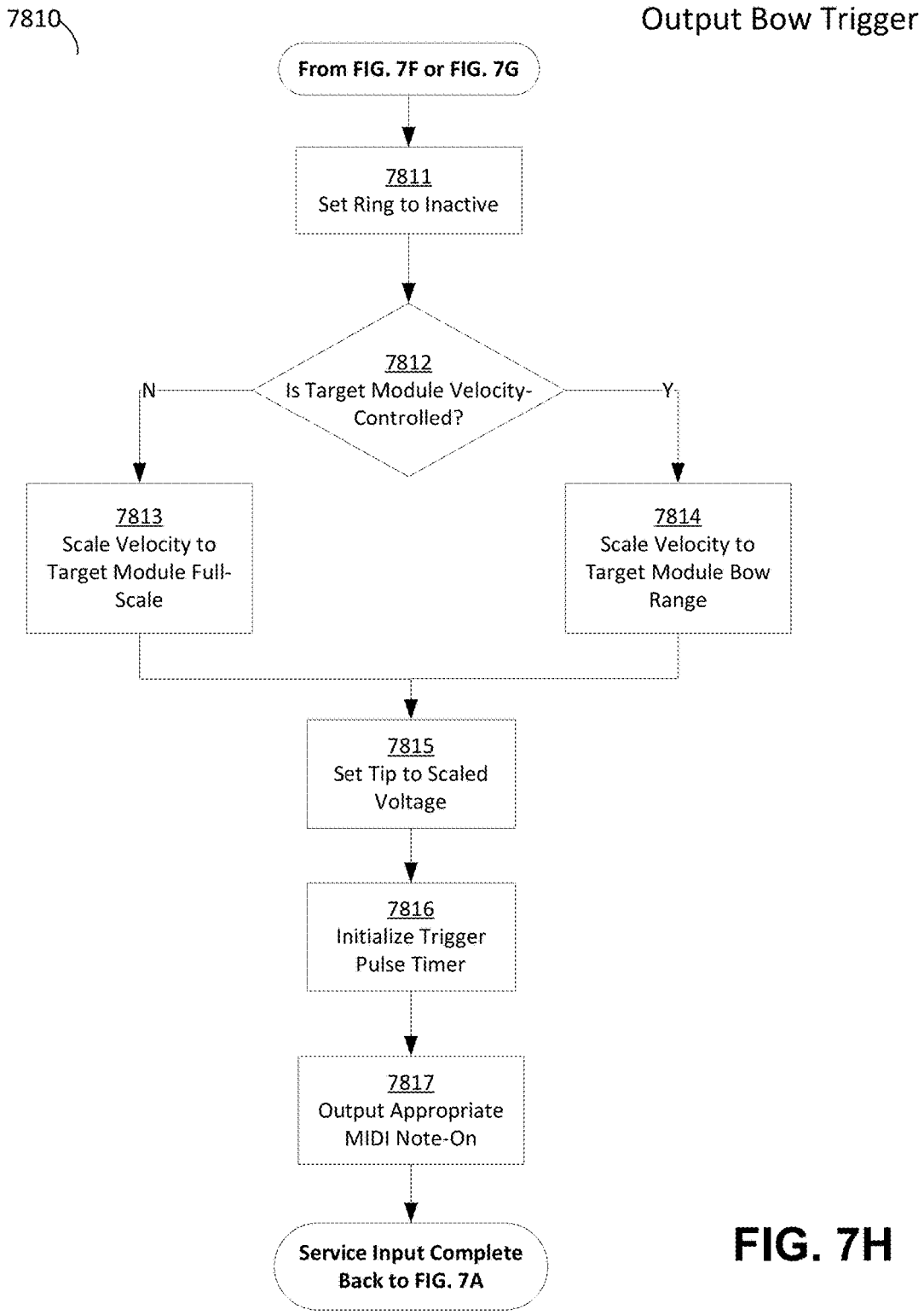
FIG. 7H illustrates a flow chart depicting a bow trigger output step of exemplary processing logic suitable for identifying a cymbal articulation, according to some embodiments.
Figure 7I:
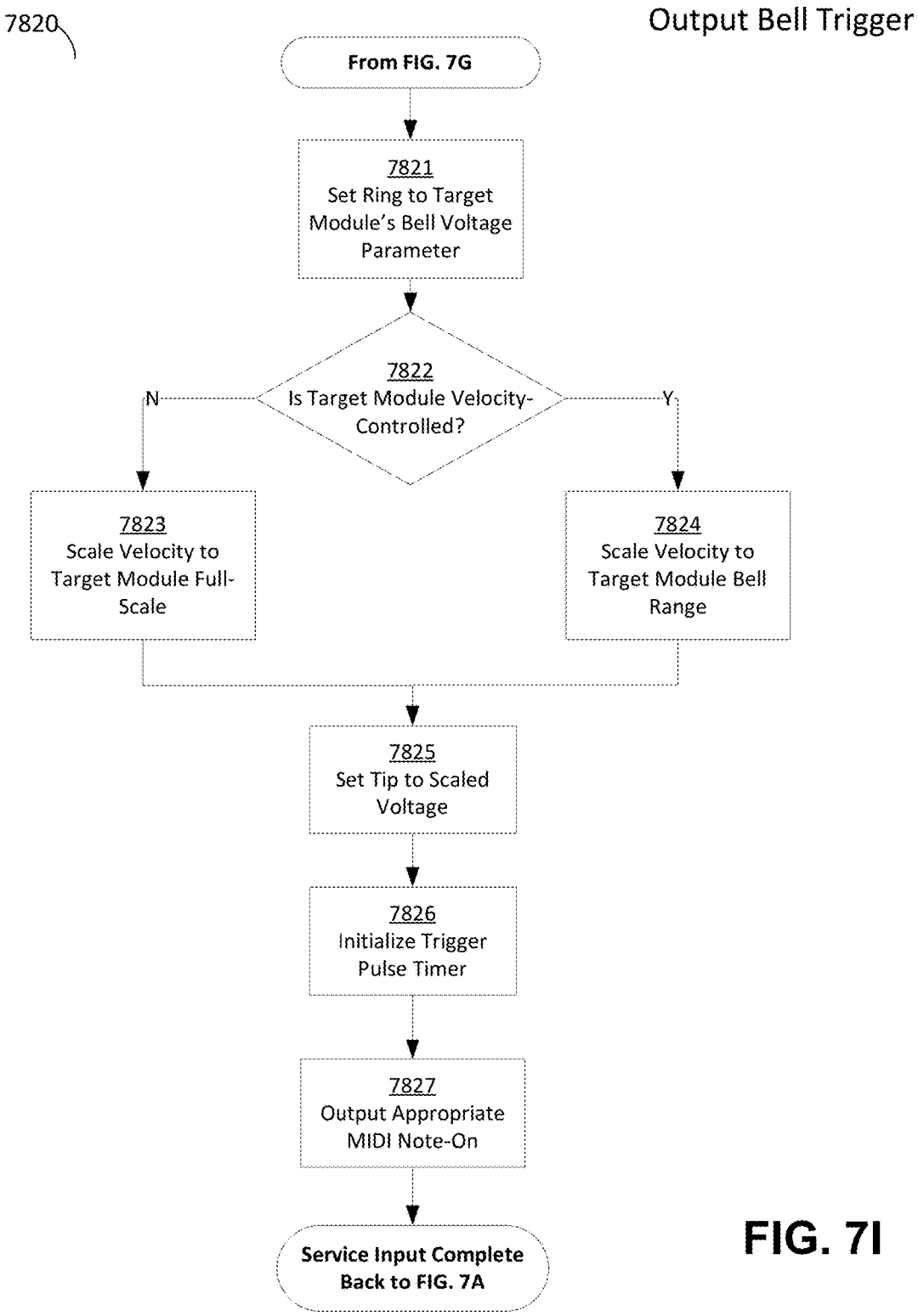
FIG. 7I illustrates a flow chart depicting a bell trigger output step of exemplary processing logic suitable for identifying a cymbal articulation, according to some embodiments.
Figure 7J:
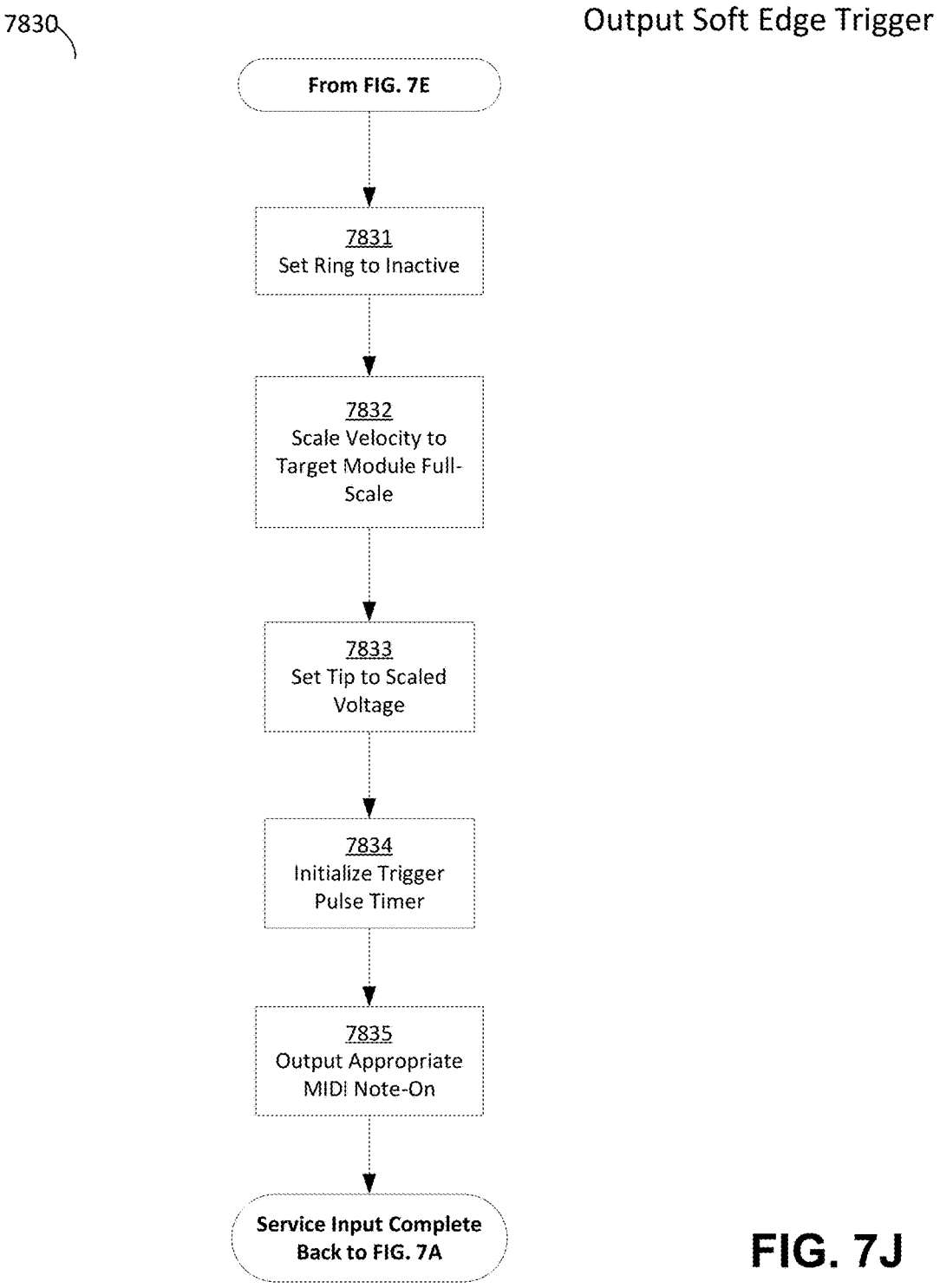
FIG. 7J illustrates a flow chart depicting a soft edge trigger output step of exemplary processing logic suitable for identifying a cymbal articulation, according to some embodiments.
Figure 7K:
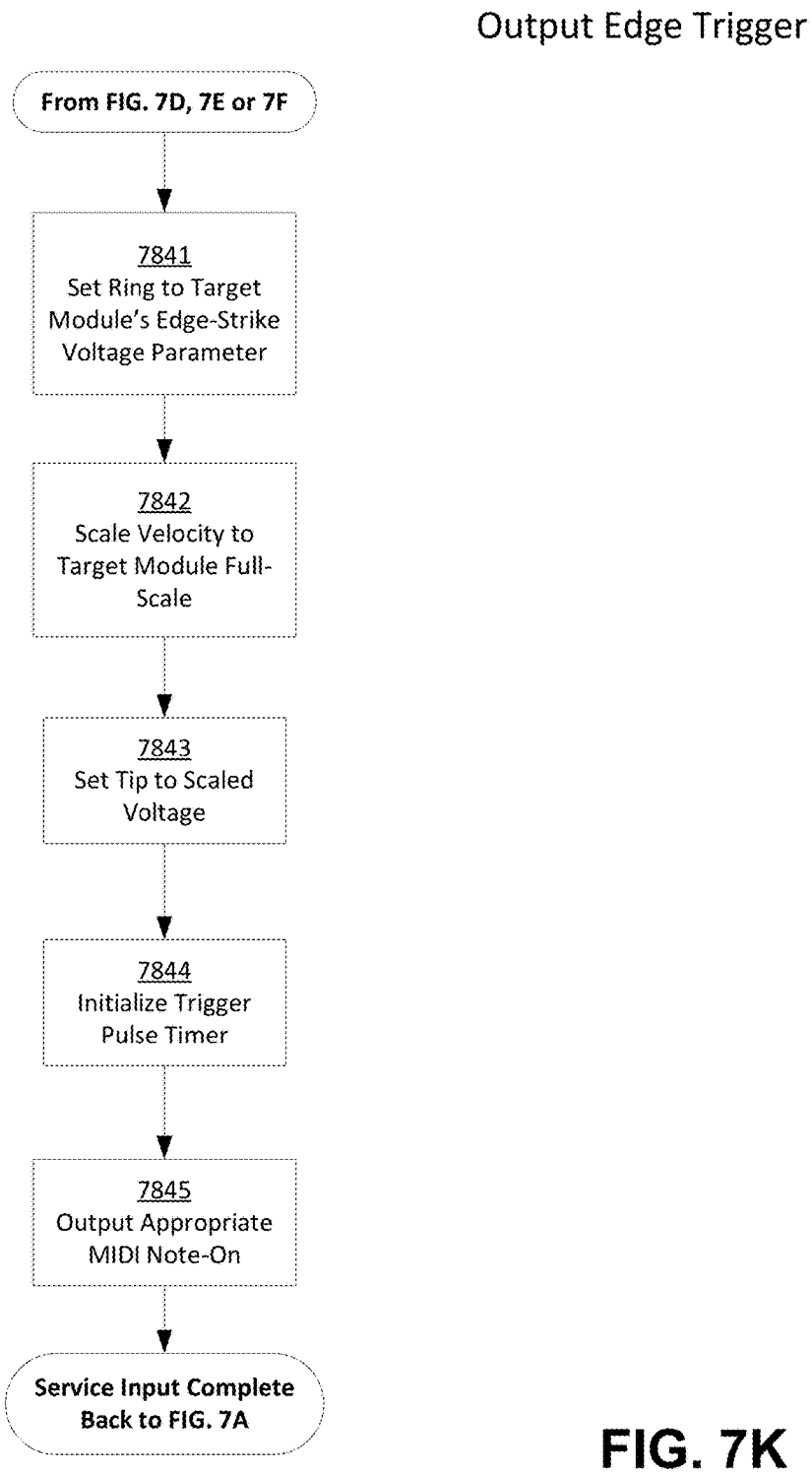
FIG. 7K illustrates a flow chart depicting an edge trigger output step of exemplary processing logic suitable for identifying a cymbal articulation, according to some embodiments.

FIG. 7H illustrates a flow chart depicting a bow trigger output step of exemplary processing logic suitable for identifying a cymbal articulation, according to some embodiments. Method 7810 illustrates a sequence of actions that may be performed to generate and output a bow trigger, once it has been determined that a bow strike has occurred (e.g., in step 763 shown in FIG. 7F and/or step 777 shown in FIG. 7G).

Method 7810 begins with step 7811 in which an output channel's ring is set to be inactive. For example, the output channel ring may be set to be inactive to ensure that no trigger signal is currently being output prior to outputting a new trigger signal.

In step 7812, whether the tone generator that will receive the trigger signal is velocity-controlled is determined. In some embodiments, the processing circuitry performing method 7810 stores or otherwise has access to one or more values describing aspects of a tone generator to which the processing circuitry is coupled. For example, the processing circuitry may ascertain whether such a tone generator is configured to receive trigger signals indicating various volumes and to output a tone with a corresponding volume based on the received trigger signal, i.e. whether the tone generator is velocity-controlled.

In the event that the target tone generator is velocity controlled, in step 7814 a velocity for a trigger signal is scaled based at least in part on a range corresponding to a bow cymbal. The bow cymbal velocity range may reflect a configuration of the tone generator (e.g., may be a voltage that is based on the tone generator's manufacturer) and/or may be a value configured by the system performing method 7810 (including user-defined variables).

Alternatively, in the event that the target tone generator is not velocity controlled, in step 7813, a velocity for a trigger signal is scaled based at least in part on a voltage defined as a full scale trigger for the target tone generator. The full scale trigger voltage may be any suitable value, such as 6V or 9V, and may depend on the target tone generator's configuration.

Irrespective of how the velocity is scaled, in step 7815, an output channel's tip is set to the scaled voltage determined in step 7813 or 7814. In step 7816, the trigger pulse timer for the bow trigger is initialized. As discussed above, the length of a trigger pulse timer may be based at least in part upon the type of strike (e.g. a bow strike), an input level, and/or a configuration of the target tone generator. In step 7817, a MIDI note-on is output to the target tone generator, which since the output channel's voltage has been initialized, will result in the target tone generator playing a tone corresponding to the bow strike. Method 7810 ends by returning to step 702 shown in FIG. 7A.

FIG. 7I illustrates a flow chart depicting a bell trigger output step of exemplary processing logic suitable for identifying a cymbal articulation, according to some embodiments. Method 7820 illustrates a sequence of actions that may be performed to generate and output a bow trigger, once it has been determined that a bow strike has occurred (e.g., in step 774 shown in FIG. 7G).

Method 7820 begins with step 7821 in which an output channel's ring is set based on a target tone generator's voltage parameter for bell strikes. In some embodiments, the processing circuitry performing method 7820 stores or otherwise has access to one or more values describing aspects of a tone generator to which the processing circuitry is coupled. For example, the processing circuitry may ascertain a voltage parameter for bell strikes that a tone generator is configured to use.

In step 7822, whether the tone generator that will receive the trigger signal is velocity-controlled is determined. In some embodiments, the processing circuitry may ascertain whether such a tone generator is configured to receive trigger signals indicating various volumes and to output a tone with a corresponding volume based on the received trigger signal, i.e. whether the tone generator is velocity-controlled.

In the event that the target tone generator is velocity controlled, in step 7824 a velocity for a trigger signal is scaled based at least in part on a range corresponding to a bell cymbal. The bell cymbal velocity range may reflect a configuration of the tone generator (e.g., may be a voltage that is based on the tone generator's manufacturer) and/or may be a value configured by the system performing method 7820 (including user-defined variables).

Alternatively, in the event that the target tone generator is not velocity controlled, in step 7823, a velocity for a trigger signal is scaled based at least in part on a voltage defined as a full scale trigger for the target tone generator. The full scale trigger voltage may be any suitable value, such as 6V or 9V, and may depend on the target tone generator's configuration.

Irrespective of how the velocity is scaled, in step 7825, an output channel's tip is set to the scaled voltage determined in step 7823 or 7824. In step 7826, the trigger pulse timer for the bell trigger is initialized. As discussed above, the length of a trigger pulse timer may be based at least in part upon the type of strike (e.g. bell strike), an input level, and/or a configuration of the target tone generator. In step 7827, a MIDI note-on is output to the target tone generator, which since the output channel's voltage has been initialized, will result in the target tone generator playing a tone corresponding to the bell strike. Method 7820 ends by returning to step 702 shown in FIG. 7A.

FIG. 7J illustrates a flow chart depicting a soft edge trigger output step of exemplary processing logic suitable for identifying a cymbal articulation, according to some embodiments. Method 7830 illustrates a sequence of actions that may be performed to generate and output a soft edge trigger, once it has been determined that a soft edge strike has occurred (e.g., in step 754 shown in FIG. 7E).

Method 7830 begins with step 7831 in which an output channel's ring in which an output channel's ring is set to be inactive. For example, the output channel ring may be set to be inactive to ensure that no trigger signal is currently being output prior to outputting a new trigger signal.

In step 7832, a velocity for a trigger signal is scaled based at least in part on a voltage defined as a full scale trigger for the target tone generator. The full scale trigger voltage may be any suitable value, such as 6V or 9V, and may depend on the target tone generator's configuration.

In step 7833, an output channel's tip is set to the scaled voltage determined in step 7832. In step 7834, the trigger pulse timer for the soft edge trigger is initialized. As discussed above, the length of a trigger pulse timer may be based at least in part upon the type of strike (e.g. a soft edge strike), an input level, and/or a configuration of the target tone generator. In step 7835, a MIDI note-on is output to the target tone generator, which since the output channel's voltage has been initialized, will result in the target tone generator playing a tone corresponding to the soft edge strike. Method 7830 ends by returning to step 702 shown in FIG. 7A.

FIG. 7K illustrates a flow chart depicting an edge trigger output step of exemplary processing logic suitable for identifying a cymbal articulation, according to some embodiments. Method 7840 illustrates a sequence of actions that may be performed to generate and output an edge trigger, once it has been determined that an edge strike has occurred (e.g., in step 745 shown in FIG. 7D, step 752 shown in FIG. 7E, and/or step 764 shown in FIG. 7F).

Method 7840 begins with step 7841 in which an output channel's ring is set based on a target tone generator's voltage parameter for edge strikes. In some embodiments, the processing circuitry performing method 7840 stores or otherwise has access to one or more values describing aspects of a tone generator to which the processing circuitry is coupled. For example, the processing circuitry may ascertain a voltage parameter for edge strikes that a tone generator is configured to use.

In step 7842, a velocity for a trigger signal is scaled based at least in part on a voltage defined as a full scale trigger for the target tone generator. The full scale trigger voltage may be any suitable value, such as 6V or 9V, and may depend on the target tone generator's configuration.

In step 7843, an output channel's tip is set to the scaled voltage determined in step 7842. In step 7844, the trigger pulse timer for the edge trigger is initialized. As discussed above, the length of a trigger pulse timer may be based at least in part upon the type of strike (e.g. an edge strike), an input level, and/or a configuration of the target tone generator. In step 7845, a MIDI note-on is output to the target tone generator, which since the output channel's voltage has been initialized, will result in the target tone generator playing a tone corresponding to the edge strike. Method 7840 ends by returning to step 702 shown in FIG. 7A.

Figure 7L:
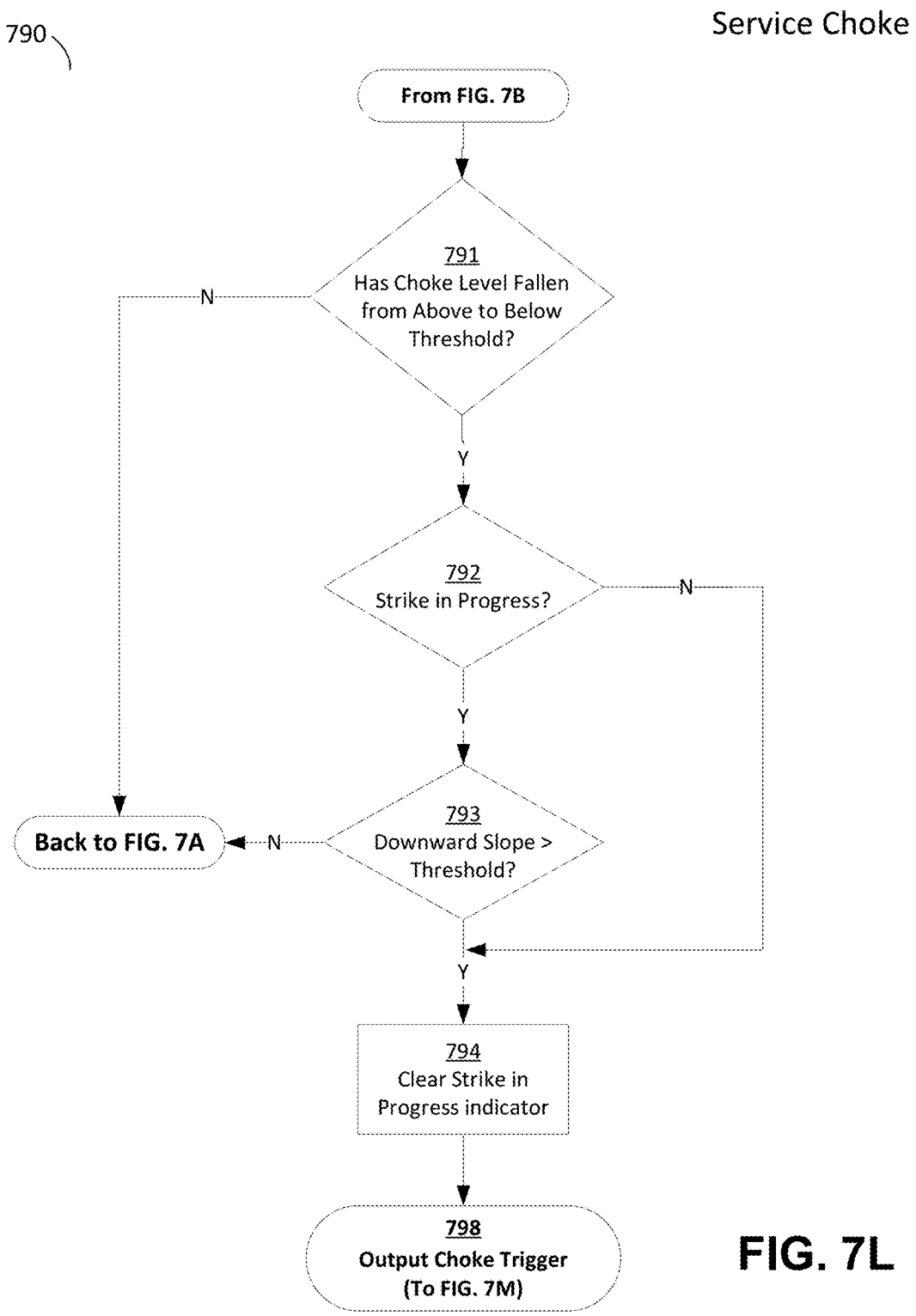
FIG. 7L illustrates a flow chart depicting a service choke step of exemplary processing logic suitable for identifying a cymbal articulation, according to some embodiments.

FIG. 7L illustrates a flow chart depicting a service choke step of exemplary processing logic suitable for identifying a cymbal articulation, according to some embodiments. As discussed above, a player of a cymbal can perform a "choke" by grabbing the cymbal by the hand to quickly dampen the sound. In some use cases a cymbal may no longer be substantially vibrating yet a player wishes to "play" a choke articulation. However, in such use cases the low amplitude of a strike input may inhibit the detection of a choke. Accordingly, it may be beneficial to alternatively, or additionally, detect a choke by recognizing contact of a player with the cymbal, such as a "slap" of the cymbal by the player's fingertips. The example of FIG. 7L includes both exemplary techniques for detecting a choke described above, namely the dampening of vibrations and the detection of a finger "slap" by a player.

Method 790 begins with step 791, in which the change in a choke detector level during an interval ending at the current time is determined, and compared with a threshold. Since a choke may be characterized by a sharp drop in amplitude (e.g., due to a player grabbing the cymbal), in step 791 it is determined whether a choke detector level fell from above a threshold that may be indicative of a strike (e.g., a bell, bow or edge strike) to below that threshold.

The choke detector level used in step 791 may be any signal indicative of an amplitude of an acoustic signal detected by a transducer, and that may be used to identify whether said amplitude has rapidly decreased in a manner signifying a choke. For example, the choke detector level may be input 452 shown in FIG. 4A and/or choke input 492 shown in FIG. 4B. The arming threshold may be any value that the choke detector level exceeds whenever a strike of the cymbal occurs.

If the choke detector level in step 791 is determined not to have fallen from above the threshold to below the threshold in the time interval, method 790 returns to FIG. 7A. Alternatively, method 700 proceeds to step 792, in which a strike in progress indicator is examined. As described above, such an indicator may allow aspects of the methods described herein to perform processing based on whether a strike has been identified as having occurred or not. An example of such processing is shown in FIG. 7L, as follows.

If the strike in progress indicator is not set, yet nonetheless the signal level was determined in step 791 not to have fallen from above the threshold to below the threshold in the time interval, this may indicate that a player "slapped" the cymbal after the cymbal's vibrations had decayed to a relatively low amplitude. Accordingly, if the strike in progress indicator is not set, method 790 proceeds to step 794.

Alternatively, if the strike in progress indicator is determined to be set in step 792, the downward slope of the choke detector level is compared with a choke threshold in step 793. The downward slope may be calculated over any suitable time period. As discussed above, a choke may be characterized as a sharp reduction in amplitude of a strike signal level. Accordingly, step 793 determines whether the choke detector level has fallen sufficiently quickly to identify a choke articulation. If the signal level has fallen quickly, thus producing a downward slope above the choke threshold, this indicates a choke articulation, and method 790 proceeds to step 794. Otherwise, if the choke detector level has fallen more slowly, thus producing a downward slope equal to or below the choke threshold, no choke articulation is identified and method 790 returns to FIG. 7A. In step 794, irrespective of its status, the strike in progress indicator is cleared.

A choke trigger is output in step 798. An exemplary process of outputting a choke trigger is illustrated in FIG. 7M.

Figure 7M:
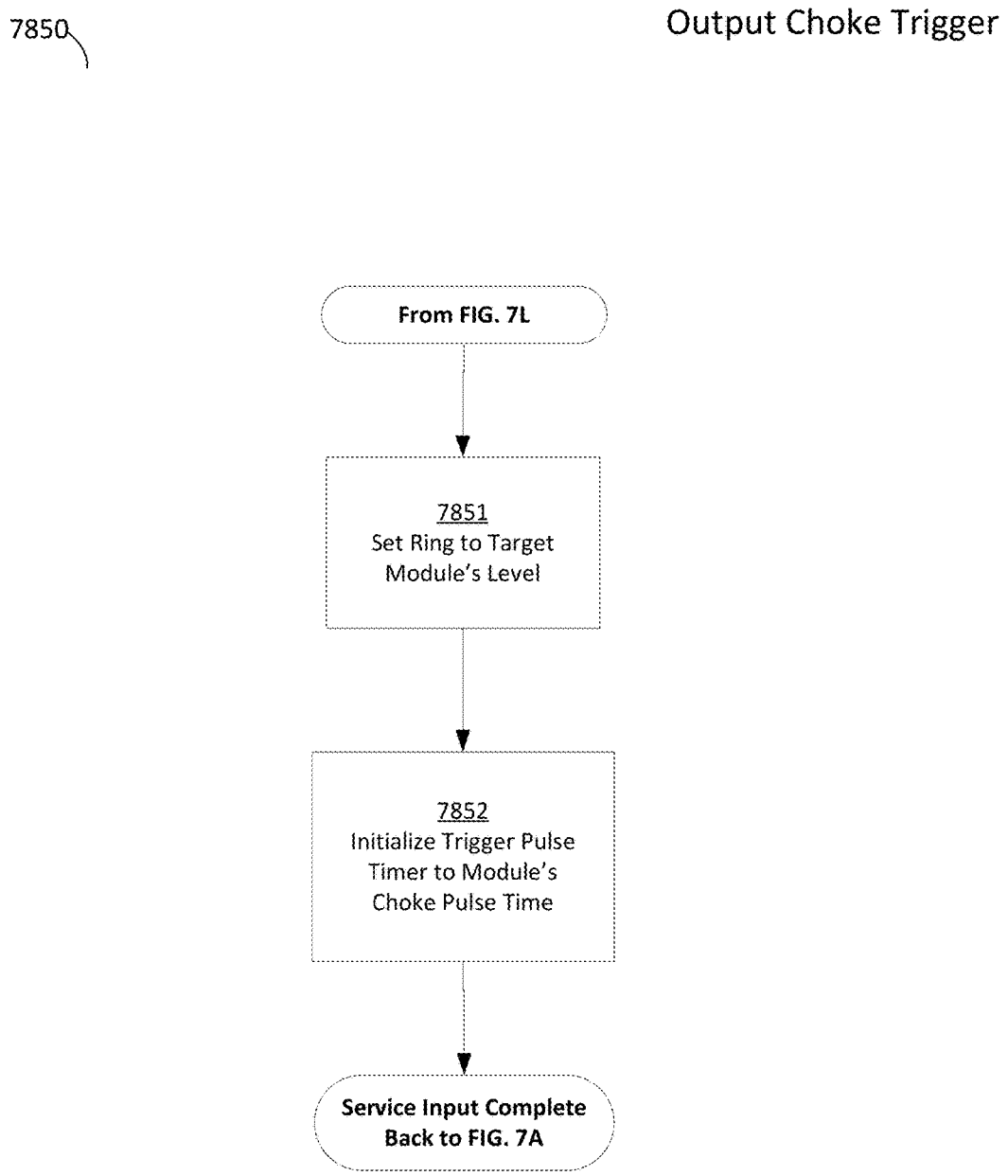
FIG. 7M illustrates a flow chart depicting a choke trigger output step of exemplary processing logic suitable for identifying a cymbal articulation, according to some embodiments.

FIG. 7M illustrates a flow chart depicting a choke trigger output step of exemplary processing logic suitable for identifying a cymbal articulation, according to some embodiments. Method 7850 illustrates a sequence of actions that may be performed to generate and output a choke trigger, once it has been determined that a choke has occurred (e.g., in step 798 shown in FIG. 7L).

Method 7850 begins with step 7851 in which an output channel's ring is set based on a target tone generator's voltage level. In some embodiments, the processing circuitry performing method 7850 stores or otherwise has access to one or more values describing aspects of a tone generator to which the processing circuitry is coupled. For example, the processing circuitry may ascertain a voltage parameter for edge strikes that a tone generator is configured to use.

In step 7852, the trigger pulse timer for the choke trigger is initialized. The trigger pulse time may be based upon any suitable choke pulse time, which may be configured by the tone generator to which the choke trigger is to be sent. Method 7850 ends by returning to step 702 shown in FIG. 7A.

Figure 9:
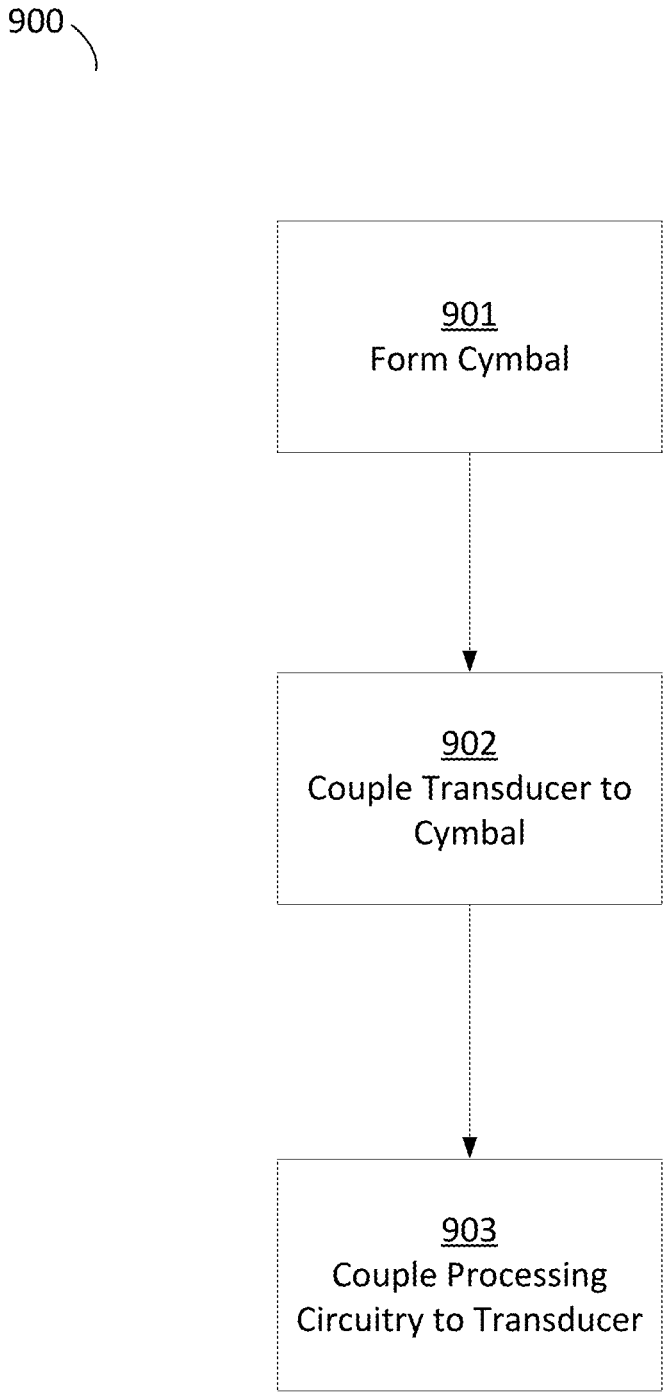
FIG. 9 illustrates a flow chart depicting an exemplary method of producing an exemplary system suitable for practicing some embodiments.

FIG. 9 illustrates a flow chart depicting an exemplary method of producing an exemplary system suitable for practicing some embodiments. Method 900 illustrates a sequence of steps in which a cymbal coupled to a transducer, which is coupled to processing circuitry, is produced. In some embodiments, method 900 may produce aspects of system 300 shown in FIG. 3. Alternatively, or additionally, method 900 may produce aspects of system 100 shown in FIG. 1.

Method 900 begins with step 901 in which a cymbal is formed. The cymbal formed in step 901 may include any type of metal structure described herein, including any type of cymbal discussed above in relation to cymbal 101 shown in FIG. 1.

In step 902, a transducer is coupled to the cymbal formed in step 901. Such coupling may be mechanical or otherwise, and may utilize any techniques for coupling a transducer to a cymbal discussed herein, including aspects discussed in relation to transducer 102 shown in FIG. 1.

In step 903, processing circuitry is coupled to the transducer. Such coupling may be via any suitable electronic means, which may include any suitable wired or wireless techniques. For example, the processing circuitry may be coupled to the transducer by any means discussed herein, such as aspects discussed in relation to processing circuitry 303 shown in FIG. 3.

In some embodiments, the transducer and processing circuitry of method 900 are provided within a single unit, for example as a single device having a common housing. In some embodiments, the processing circuitry of method 900 is provided as a separate device from the transducer of method 900, which are coupled to one another via a wired or wireless connection.

Having herein described several embodiments, several advantages of embodiments of the present application should be apparent. One advantage is that embodiments may allow for a means and method of deriving cymbal articulation event information from a relatively undamped, vibratory, metal cymbal without the use of mechanical switches, thus offering advantages over conventional electronic cymbals in terms of playing feel and aesthetics, in addition to advantages in simplicity of construction and mechanical complexity.

It should be appreciated that the electronic cymbal and its components described herein may have any suitable dimensions, and embodiments of the electronic cymbal are not limited to any dimensions or shapes indicated above. For example, a cymbal suitable for use with embodiments described herein may have a size ranging anywhere from 6" to several feet, and may have any suitable shape. In particular, cymbals either with or without a "bell" or "cup" region may be used with embodiments described herein, as while embodiments described herein make reference to those features of cymbals, the techniques and methods described herein are not limited to use with cymbals having such features.

Aspects of the electronic cymbal described herein may be implemented to recognize any cymbal articulations corresponding to any type of strike of a cymbal. For example, while articulations resulting from drum sticks have been described herein, the various methods and structures described herein may be used with articulations created by any suitable striking method, such as by using hands or other body parts, brushes and/or mallets to strike a cymbal. It will further be appreciated that cymbal articulations other than those described herein may be detected and/or identified by utilizing the various methods and structures described herein. For example, a strike of a cymbal stand or other apparatus to which a cymbal is coupled may be identified as a cymbal articulation. In some embodiments, one or more cymbal articulations differ in the object used to strike the cymbal, and do not necessarily differ in the location of the strike on the cymbal. For example, a brush and a stick strike of one region of one particular cymbal may be identified as distinct cymbal articulations.

The various methods and structures outlined herein may be implemented using any suitable materials. While particular materials and methods are described above, the methods and structures can be readily implemented using any combination of materials having suitable properties for practicing embodiments described herein. In particular, cymbals suitable for use with embodiments described herein may comprise any metal, including but not limited to, any type of bronze (including B8 and B20 alloys), any type of steel (including low carbon steel), and/or combinations thereof.

Various inventive concepts may be embodied as one or more methods, of which examples have been provided. The acts performed as part of any method described herein may be ordered in any suitable way. Accordingly, embodiments may be constructed in which acts are performed in an order different than illustrated, which may include performing some acts simultaneously, even though shown as sequential acts in illustrative embodiments.

Aspects of the various methods or processes outlined herein may be implemented in any suitable hardware, such as one or more processors (including microprocessors), Field Programmable Gate Arrays (FPGAs) or Application Specific Integrated Circuits (ASICs). Data structures, including buffers, timers and/or user variables, may be stored in non-transitory computer-readable storage media in any suitable form, and/or may be formed, at least in part, from digital circuitry.

All definitions, as defined and used herein, should be understood to control over dictionary definitions, definitions in documents incorporated by reference, and/or ordinary meanings of the defined terms.

The indefinite articles "a" and "an," as used herein, unless clearly indicated to the contrary, should be understood to mean "at least one."

As used herein, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art.

For example, techniques of deriving cymbal event articulation information were described. These techniques may be applied in other contexts. For example, using acoustic information resulting from any type of strike of any metal plate to ascertain a manner in which the metal plate was struck may use techniques as described herein. Such modifications and improvements are intended to be within the spirit and scope of the invention. Accordingly, the foregoing description is by way of example only, and is not intended as limiting.

What is claimed is:

1. A cymbal system comprising:

a metal plate;

a transducer, comprising a capacitive accelerometer, coupled to the metal plate and configured to detect an acoustic signal generated by a strike of the metal plate; and processing circuitry coupled to the transducer and configured to determine a cymbal articulation for the strike of the metal plate based on the detected acoustic signal.

2. The cymbal system of claim 1, wherein the processing circuitry includes a low-pass filter, a high pass filter, a band pass filter, a peak detector and/or an envelope detector.

3. The cymbal system of claim 1, wherein the processing circuitry includes a microcontroller.

4. The cymbal system of claim 1, further including a tone generator, coupled to the processing circuitry, configured to initiate playback of a tone for the strike of the metal plate according to the determined cymbal articulation.

5. The cymbal system of claim 1, wherein the processing circuitry is configured to:

identify a portion of the acoustic signal within a first frequency band; and determine the cymbal articulation for the strike of the metal plate based at least in part on the portion of the acoustic signal.

6. The cymbal system of claim 5, wherein the cymbal articulation is determined based at least in part on a time-varying amplitude of the portion of the acoustic signal.

7. The cymbal system of claim 5, wherein the first frequency band is a range of frequencies above 500 Hz.

8. The cymbal system of claim 1, wherein the metal plate includes a plurality of perforations.

9. The cymbal system of claim 1, wherein the metal plate comprises steel and/or bronze.

10. The cymbal system of claim 1, wherein the perimeter of the metal plate is circular and includes a bell shape in cross section.

11. The cymbal system of claim 1, wherein the determined cymbal articulation is one of: a bow strike, a bell strike, an edge strike or a choke.

* * * * *